US011549721B2

(12) United States Patent
Onaka et al.

(10) Patent No.: US 11,549,721 B2
(45) Date of Patent: Jan. 10, 2023

(54) HEAT EXCHANGE UNIT AND AIR-CONDITIONING APPARATUS INCLUDING THE SAME

(71) Applicant: Mitsubishi Electric Corporation, Chiyoda-ku (JP)

(72) Inventors: Yoji Onaka, Chiyoda-ku (JP); Makoto Tanishima, Chiyoda-ku (JP); Takashi Matsumoto, Chiyoda-ku (JP); Takamasa Uemura, Chiyoda-ku (JP); Hiroki Fukuoka, Chiyoda-ku (JP); Rihito Adachi, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 253 days.

(21) Appl. No.: 16/763,429

(22) PCT Filed: Nov. 20, 2018

(86) PCT No.: PCT/JP2018/042819
§ 371 (c)(1),
(2) Date: May 12, 2020

(87) PCT Pub. No.: WO2019/116838
PCT Pub. Date: Jun. 20, 2019

(65) Prior Publication Data

US 2020/0309407 A1 Oct. 1, 2020

(30) Foreign Application Priority Data

Dec. 13, 2017 (JP) ..... JP2017-238779

(51) Int. Cl.
*F24F 13/30* (2006.01)

(52) U.S. Cl.
CPC ..... *F24F 13/30* (2013.01)

(58) Field of Classification Search
CPC ..... F24F 13/30; F24F 2013/205; F24F 13/20; F24F 1/0022; F24F 1/0063
See application file for complete search history.

(56) References Cited

U.S. PATENT DOCUMENTS 4,449,376 A * 5/1984 Draper ..... F25B 39/00 62/448
4,813,345 A * 3/1989 Kobayashi ..... F24F 13/20 62/263

(Continued)

FOREIGN PATENT DOCUMENTS

EP 1 775 524 A1 4/2007
EP 2 722 609 A1 4/2014

(Continued)

OTHER PUBLICATIONS

International Search Report dated Feb. 12, 2019 in PCT/JP2018/042819 filed Nov. 20, 2018, 2 pages.

(Continued)

*Primary Examiner* — Kun Kai Ma
(74) *Attorney, Agent, or Firm* — Xsensus LLP

(57) ABSTRACT

A heat exchange unit includes a housing having an inflow air passage communicating with an air inlet, and an outflow air passage communicating with an air outlet, a first partition plate that partitions an inside of the housing into the inflow air passage and the outflow air passage, a bellmouth disposed around an opening formed in the first partition plate, a centrifugal fan disposed on the first partition plate via the bellmouth, and a heat exchanger disposed on a downstream side of the centrifugal fan in the housing. The air inlet is open at any surface of the housing having the inflow air passage. The air outlet is open at any side surface of the housing having the outflow air passage. The inflow air passage is formed between a fan inlet and a main plate (Continued)

closest to the fan inlet to reach a rear surface. The fan inlet is an air inlet of the centrifugal fan.

14 Claims, 27 Drawing Sheets

(56) References Cited

U.S. PATENT DOCUMENTS

| | | | | |
|---|---|---|---|---|
| 6,342,005 | B1 * | 1/2002 | Daniels | F24F 13/24 454/906 |
| 6,393,856 | B1 * | 5/2002 | Gunji | F24F 13/082 62/298 |
| 2007/0116559 | A1 * | 5/2007 | Higashida | F24F 1/0083 415/206 |
| 2010/0159818 | A1 * | 6/2010 | Sakashita | F24F 1/0063 454/233 |
| 2010/0199697 | A1 * | 8/2010 | Sakashita | F24F 1/0073 62/426 |
| 2010/0287968 | A1 * | 11/2010 | Sakashita | F24F 8/10 62/303 |
| 2013/0168064 | A1 * | 7/2013 | Akiyoshi | F24F 1/0011 165/121 |
| 2013/0213614 | A1 * | 8/2013 | Ikeda | F24F 1/0047 165/104.34 |
| 2015/0013376 | A1 * | 1/2015 | Yoshimura | F24F 1/38 62/507 |
| 2015/0040609 | A1 * | 2/2015 | Yamauchi | F24F 1/58 62/508 |
| 2015/0071775 | A1 * | 3/2015 | Kashihara | F24F 1/0071 415/206 |
| 2015/0300688 | A1 * | 10/2015 | Yokoyama | F24H 9/0073 392/360 |
| 2015/0316277 | A1 * | 11/2015 | Uemura | F24F 1/18 62/426 |
| 2016/0076790 | A1 * | 3/2016 | Kojima | F24F 1/0014 454/237 |
| 2016/0138839 | A1 * | 5/2016 | Suhara | F24F 1/0071 62/160 |
| 2017/0089605 | A1 * | 3/2017 | Kim | F24F 11/79 |
| 2017/0167737 | A1 * | 6/2017 | Kil | F24F 1/04 |
| 2018/0010812 | A1 * | 1/2018 | Moro | F24F 1/0057 |
| 2018/0209440 | A1 * | 7/2018 | Kono | F04D 29/667 |
| 2019/0040873 | A1 * | 2/2019 | Tadokoro | F04D 29/667 |
| 2019/0049186 | A1 * | 2/2019 | Yoshimura | F28F 1/04 |
| 2019/0101131 | A1 * | 4/2019 | Kono | F04D 29/162 |
| 2019/0242612 | A1 * | 8/2019 | Teramoto | F24F 1/0033 |
| 2019/0316790 | A1 * | 10/2019 | Goto | F24F 1/38 |
| 2020/0248924 | A1 * | 8/2020 | Suzuki | F24F 11/38 |
| 2020/0284468 | A1 * | 9/2020 | Adachi | F24F 1/18 |
| 2020/0309151 | A1 * | 10/2020 | Tanishima | F04D 29/663 |
| 2021/0123638 | A1 * | 4/2021 | Yoshioka | F25B 39/00 |

FOREIGN PATENT DOCUMENTS

| | | | |
|---|---|---|---|
| JP | 59-52320 | U | 4/1984 |
| JP | 2-64824 | U | 5/1990 |
| JP | 9-145100 | A | 6/1997 |
| JP | 2000-356362 | A | 12/2000 |
| JP | 2001-82396 | A | 3/2001 |
| JP | 2006-29616 | A | 2/2006 |
| JP | 2006-336909 | A | 12/2006 |
| JP | 2008-241143 | A | 10/2008 |
| JP | 2009-24595 | A | 2/2009 |
| JP | 2016-156512 | A | 9/2016 |
| JP | 2016-223638 | A | 12/2016 |
| WO | 2016/158252 | A1 | 10/2016 |

OTHER PUBLICATIONS

Japanese Office Action dated Jul. 1, 2019 in Japanese Patent Application No. 2019-526337 (with English translation), 11 pages.

Extended European Search Report dated Nov. 24, 2020 in European Patent Application No. 18889396.0, 11 pages.

* cited by examiner

HEAT EXCHANGE UNIT AND AIR-CONDITIONING APPARATUS INCLUDING THE SAME

TECHNICAL FIELD

The present disclosure relates to a heat exchange unit and an air-conditioning apparatus including the heat exchange unit.

BACKGROUND ART

For example, Patent Literature 1 discloses an air-conditioning apparatus including a housing having an air inlet and an air outlet, a bellmouth disposed in the housing, a centrifugal fan disposed behind the bellmouth, and heat exchangers disposed around the centrifugal fan. In the air-conditioning apparatus described in Patent Literature 1, air sucked through the air inlet is blown through the air outlet via the bellmouth, the centrifugal fan, and the heat exchangers.

CITATION LIST

Patent Literature

Patent Literature 1: Japanese Unexamined Patent Application Publication No.
2000-356362

SUMMARY OF INVENTION

Technical Problem

If the heat exchangers are disposed around the centrifugal fan as in the air-conditioning apparatus described in Patent Literature 1, air hardly flows into the heat exchanger located away from the air outlet, that is, closer to the center of the housing, and the efficiency of the heat exchanger decreases significantly. Therefore, the efficiency of the heat exchanger is significantly affected by the position where the air outlet is provided. As a result, there is a restriction on the positions where the air inlet and the air outlet are provided. Thus, the housing of the air-conditioning apparatus described in Patent Literature 1 has a low degree of freedom in terms of disposition depending on actual buildings and layouts. Further, the structures of housings of a majority of related-art air-conditioning apparatus are similar to that of the housing of the air-conditioning apparatus described in Patent Literature 1.

The present disclosure has been made in view of the problem described above and an object thereof is to provide a heat exchange unit in which the degree of freedom in terms of disposition is improved and air flowing to a rear side of a centrifugal fan (away from an air outlet) efficiently passes through a heat exchanger, and to provide an air-conditioning apparatus including the heat exchange unit.

Solution to Problem

A heat exchange unit according to an embodiment of the present disclosure includes a housing having an inflow air passage communicating with an air inlet, and an outflow air passage communicating with an air outlet, a first partition plate that partitions an inside of the housing into the inflow air passage and the outflow air passage, a bellmouth disposed around an opening formed in the first partition plate, a centrifugal fan disposed on the first partition plate via the bellmouth, and a heat exchanger disposed on a downstream side of the centrifugal fan in the housing. The air inlet is open at any surface of the housing having the inflow air passage. The air outlet is open at any side surface of the housing having the outflow air passage. The inflow air passage is formed between a fan inlet and a main plate closest to the fan inlet to reach a rear surface. The fan inlet is an air inlet of the centrifugal fan.

Advantageous Effects of Invention

In the heat exchange unit according to the embodiment of the present disclosure, the air inlet can be formed at any surface of the housing having the inflow air passage and the air outlet can be formed at any side surface of the housing having the outflow air passage. Therefore, the degree of freedom in terms of disposition can be improved. Further, the inflow air passage runs from the air inlet of the centrifugal fan along the main plate closest to the air inlet of the centrifugal fan to reach the rear surface. Therefore, a wide space can be secured between the centrifugal fan and the rear surface of the housing. Thus, air blown to the rear side of the centrifugal fan (away from the air outlet) can efficiently pass through the heat exchanger.

DESCRIPTION OF EMBODIMENTS

Figure 1:
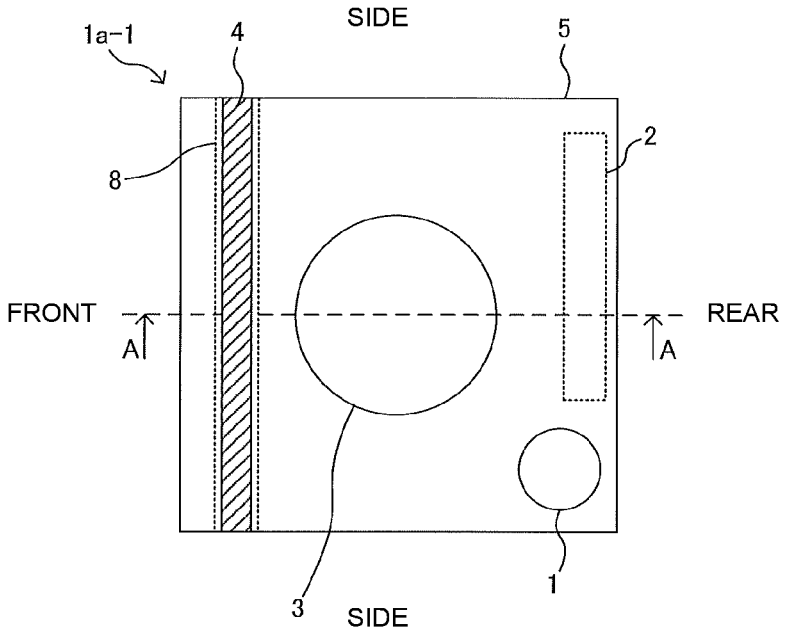
FIG. 1 is a schematic top view schematically illustrating a state in which a heat source device that is one type of a heat exchange unit according to Embodiment 1 of the present disclosure is viewed from the top.

Embodiments 1 to 10 of the present disclosure are described below with reference to the drawings. Note that, in the drawings including FIG. 1 to which reference is made below, the size relationship between components may differ from an actual size relationship. Further, in the drawings including FIG. 1 to which reference is made below, components shown by the same reference signs are the identical or corresponding components and are common throughout the description herein. Further, the forms of components that are defined throughout the description herein are illustrative in all respects and the forms are not limited to those in the description.

Embodiment 1

Figure 2:
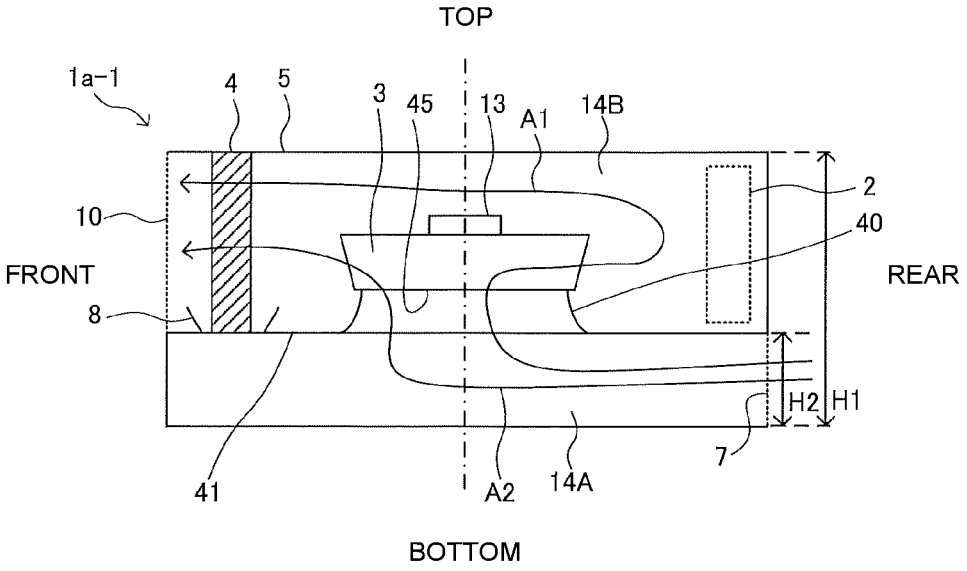
FIG. 2 is a schematic sectional view schematically illustrating an example of a cross section taken along the line A-A in FIG. 1.
Figure 3:
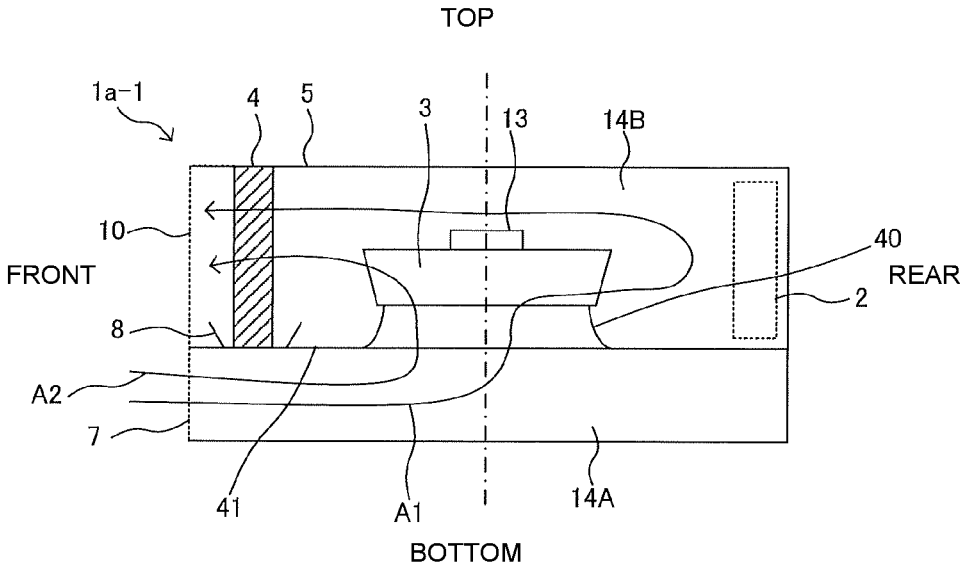
FIG. 3 is a schematic sectional view schematically illustrating another example of the cross section taken along the line A-A in FIG. 1.
Figure 4:
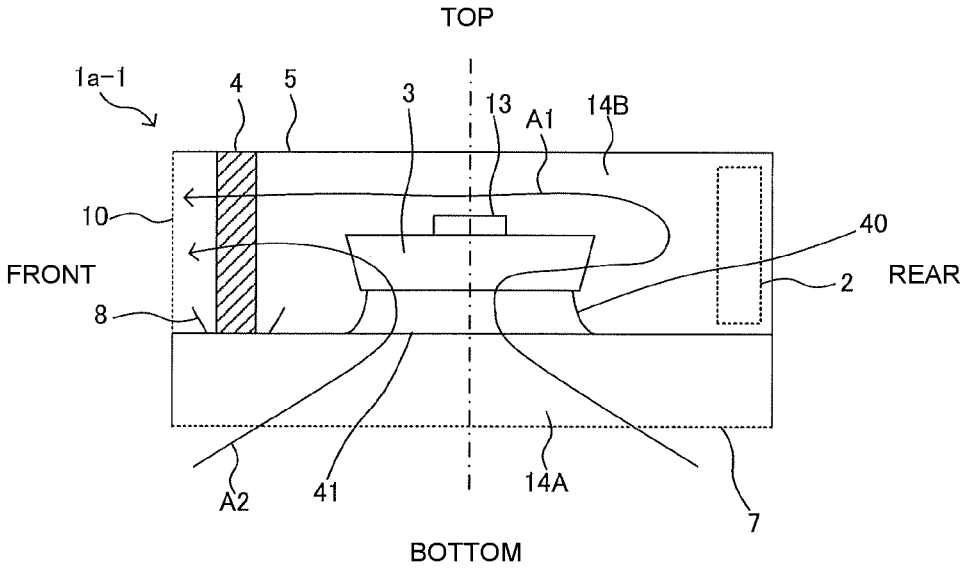
FIG. 4 is a schematic sectional view schematically illustrating still another example of the cross section taken along the line A-A in FIG. 1.

FIG. 1 is a schematic top view schematically illustrating a state in which a heat source device 1*a*-1 that is one type of a heat exchange unit according to Embodiment 1 of the present disclosure is viewed from the top. FIG. 2 is a schematic sectional view schematically illustrating an example of a cross section taken along the line A-A in FIG. 1. FIG. 3 is a schematic sectional view schematically illustrating another example of the cross section taken along the line A-A in FIG. 1. FIG. 4 is a schematic sectional view schematically illustrating still another example of the cross section taken along the line A-A in FIG. 1. The heat source device 1*a*-1 is described below with reference to FIG. 1 to FIG. 4. Note that FIG. 1 schematically illustrates the inside of the heat source device 1*a*-1. Further, in FIG. 2 to FIG. 4, airflows are shown by an arrow A1 and an arrow A2. Further, FIG. 1 to FIG. 4 each illustrates an exemplary state in which the right in the drawing sheet is the rear of the heat source device 1*a*-1 and the left in the drawing sheet is the front of the heat source device 1*a*-1.

The heat source device 1*a*-1 according to Embodiment 1 is included in an air-conditioning apparatus together with a load-side device. For example, the air-conditioning apparatus is used for heating or cooling a room in a house, building, or apartment house, that is, an air-conditioned space. The air-conditioning apparatus has a refrigerant circuit in which devices mounted on the load-side device and the heat source device 1*a*-1 are connected by pipes. The air-conditioning apparatus heats or cools the air-conditioned space by causing refrigerant to circulate through the refrigerant circuit.

Note that the air-conditioning apparatus is described in Embodiment 10.

The heat source device 1*a*-1 is one type of a heat exchange unit including a heat exchanger and is used as an outdoor unit or a heat source unit.

The load-side device is also one type of the heat exchange unit including the heat exchanger and is used as a load-side unit, a use-side unit, or an indoor unit. Note that the load-side device is described in Embodiment 9.

As illustrated in FIG. 1 and FIG. 2, the heat source device 1*a*-1 includes at least one heat exchanger 4, a compressor 1, a control box 2, a centrifugal fan 3, a bellmouth 40, a fan motor 13, and a drain pan 8. The heat exchanger 4, the compressor 1, the control box 2, the centrifugal fan 3, the bellmouth 40, the fan motor 13, and the drain pan 8 are disposed in a housing 5 that is an outer shell of the heat source device 1*a*-1. Here, two upper and lower surfaces on the drawing sheet in a rotational axis direction of the centrifugal fan are defined as main plates and surfaces in a rotational direction of the centrifugal fan are defined as side surfaces.

The housing 5 has an air inlet 7 and an air outlet 10. The air inlet 7 and the air outlet 10 are open so that the inside and outside of the housing 5 communicate with each other. For example, the air inlet 7 is open at the front, rear, side, or bottom of the housing 5. For example, the air outlet 10 is open at the front of the housing 5. That is, the heat source device 1*a*-1 does not take in and blow air from the bottom or top of the housing 5, but takes in air from one side of the housing 5 and blows air from the front of the housing 5.

The heat exchanger 4 is provided between a downstream part of the centrifugal fan 3 and the air outlet 10.

The centrifugal fan 3 sends air by rotating about its axis. The centrifugal fan 3 is disposed on a partition plate 41 via the bellmouth 40. The centrifugal fan 3 is driven to rotate by the fan motor 13.

The bellmouth 40 is disposed on a suction side of the centrifugal fan 3 and guides air flowing through an inflow air passage 14A to the centrifugal fan 3. The bellmouth 40 has a part that is gradually tapered from its inlet close to the inflow air passage 14A toward the centrifugal fan 3.

The drain pan 8 is provided below the heat exchanger 4.

Further, the housing 5 has the inflow air passage 14A and an outflow air passage 14B defined by the partition plate 41. That is, the housing 5 is provided with the partition plate 41 that partitions the housing 5 into upper and lower parts to define the inflow air passage 14A and the outflow air passage 14B. The partition plate 41 has an opening through which the inflow air passage 14A communicates with the centrifugal fan 3. The bellmouth 40 is disposed around the opening. Note that the partition of the housing 5 into upper and lower parts means that the housing 5 is partitioned into upper and lower parts in the state illustrated in FIG. 2.

The partition plate 41 corresponds to a "first partition plate".

The inflow air passage 14A communicates with the outside of the housing 5 via the air inlet 7 and is a space where air having passed through the air inlet 7 always passes before being sucked into the centrifugal fan 3. As illustrated in FIG. 2, the inflow air passage 14A is formed at the bottom in the housing 5 and communicates with the air inlet 7 to guide air taken in through the air inlet 7 to the bellmouth 40.

The outflow air passage 14B communicates with the outside of the housing 5 via the air outlet 10 and is a space where air having passed through the centrifugal fan 3 always passes. The outflow air passage 14B is formed at the top in the housing 5 and communicates with the air outlet 10 to guide air blown from the centrifugal fan 3 to the air outlet 10.

By providing the partition plate 41, the housing 5 has a two-stage structure. Thus, the orientation of the air inlet 7 can be changed by simply detaching and attaching a part of the inflow air passage 14A. That is, in the heat source device 1*a*-1, the orientation of the air inlet 7 can be selected from among the front, the side located at the top in the drawing sheet of FIG. 1, the rear, and the side located at the bottom in the drawing sheet of FIG. 1. Thus, according to the heat source device 1*a*-1, the degree of freedom in terms of disposition is high because the orientation of the air inlet 7 can be changed depending on the place where the heat source device 1*a*-1 is disposed. Specifically, the air inlet 7 can be formed at any position selected from the front, the side located at the top in the drawing sheet of FIG. 1, the rear, and the side located at the bottom in the drawing sheet of FIG. 1 by detaching and attaching a part of the side surface of the housing 5.

Note that the part of the inflow air passage 14A includes, for example, a metal plate serving as the bottom of the inflow air passage 14A, metal plates serving as the sides of the inflow air passage 14A, and fasteners such as screws for fixing the metal plates. The air outlet 10 can also be formed at any position selected from the front, the side located at the top in the drawing sheet of FIG. 1, the rear, and the side located at the bottom in the drawing sheet of FIG. 1 by detaching and attaching a part of the side surface of the housing 5.

In the housing 5 illustrated in FIG. 2, the air inlet 7 is formed at the rear surface of the housing 5 and the air outlet 10 is formed at the front surface of the housing 5. In this case, as shown by the arrow A1 and the arrow A2 in FIG. 2, air is taken in from the rear surface of the housing 5, sucked from the bottom of the centrifugal fan 3 via the bellmouth 40, blown in a circumferential direction of the centrifugal fan 3, heated or cooled by the heat exchanger 4, and blown from the front surface of the housing 5.

In the housing 5 illustrated in FIG. 3, the air inlet 7 is formed at the front surface of the housing 5 and the air outlet 10 is formed at the front surface of the housing 5. In this case, as shown by the arrow A1 and the arrow A2 in FIG. 3, air is taken in from the front surface of the housing 5, sucked from the bottom of the centrifugal fan 3 via the bellmouth 40, blown in the circumferential direction of the centrifugal fan 3, heated or cooled by the heat exchanger 4, and blown from the front surface of the housing 5.

In the housing 5 illustrated in FIG. 4, the air inlet 7 is formed at the bottom of the housing 5 and the air outlet 10 is formed at the front surface of the housing 5. In this case, as shown by the arrow A1 and the arrow A2 in FIG. 4, air is taken in from the bottom of the housing 5, sucked from the bottom of the centrifugal fan 3 via the bellmouth 40, blown in the circumferential direction of the centrifugal fan 3, heated or cooled by the heat exchanger 4, and blown from the front surface of the housing 5. By providing the air inlet 7 at the bottom of the housing 5, the opening area of the air inlet 7 can be increased and an air passage resistance is reduced in the air inlet 7.

Here, focusing on the structure illustrated in FIG. 2, the inflow air passage 14A runs from a fan inlet 45, which is an air inlet of the centrifugal fan 3, faces one main plate of the housing 5 via the bellmouth 40, and reaches the rear surface. With this structure, a wide space is secured for the outflow air passage 14B of the centrifugal fan 3. As illustrated in FIG. 2, H1 is the height of the housing 5 and H2 is the height of the air inlet 7. Then, the air inlet height H2 of the inflow air passage 14A relative to the housing height H1 significantly affects the air passage resistance of the heat exchange unit.

Figure 5:
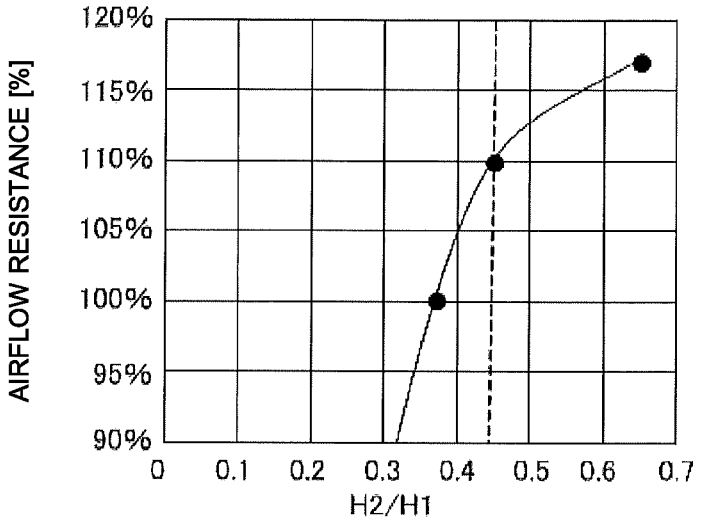
FIG. 5 is a graph illustrating an example of a relationship between an airflow resistance and a ratio between an air inlet height and a housing height in the heat exchange unit illustrated in FIG. 2.

FIG. 5 illustrates an example of an analysis result in an experiment conducted by the inventors. FIG. 5 is a graph illustrating an example of a relationship between an airflow resistance and a ratio between the air inlet height and the housing height in the heat exchange unit illustrated in FIG. 2. The horizontal axis of FIG. 5 is a value of the ratio between the air inlet height H2 and the housing height H1 (H2/H1). The vertical axis of FIG. 5 is the airflow resistance. FIG. 5 illustrates a relationship between the value of the ratio (H2/H1) and the airflow resistance in an experiment in which the air inlet height H2 is a predetermined value and the housing height H1 is changed within a range of 500 mm or smaller. The airflow resistance sharply decreases when the value of the ratio (H2/H1) falls within a range of about 0.45 or smaller. Thus, air is likely to flow efficiently relative to the height of the housing 5 by setting the air inlet height H2 of the inflow air passage 14A so that the value of the ratio (H2/H1) falls within the range of 0.45 or smaller in the structure in which the housing height H1 is 500 mm or smaller. As a result, airflow efficiency is improved.

Note that FIGS. 2 to 4 each illustrates the exemplary case where the air inlet 7 is formed at one side of the housing 5 but the air inlet 7 is not limited to that in this structure. Air inlets 7 may be formed at a plurality of sides of the housing 5. Thus, the air passage resistance is further reduced.

Further, the opening area of the air inlet 7 is not particularly limited. The air inlet 7 may be an opening formed in a part of the rear surface of the housing 5 or in the entire rear surface of the housing 5. Further, the number of air inlets 7 is not particularly limited.

Here, description is made of a case where airflows are viewed from the top.

Figure 6:
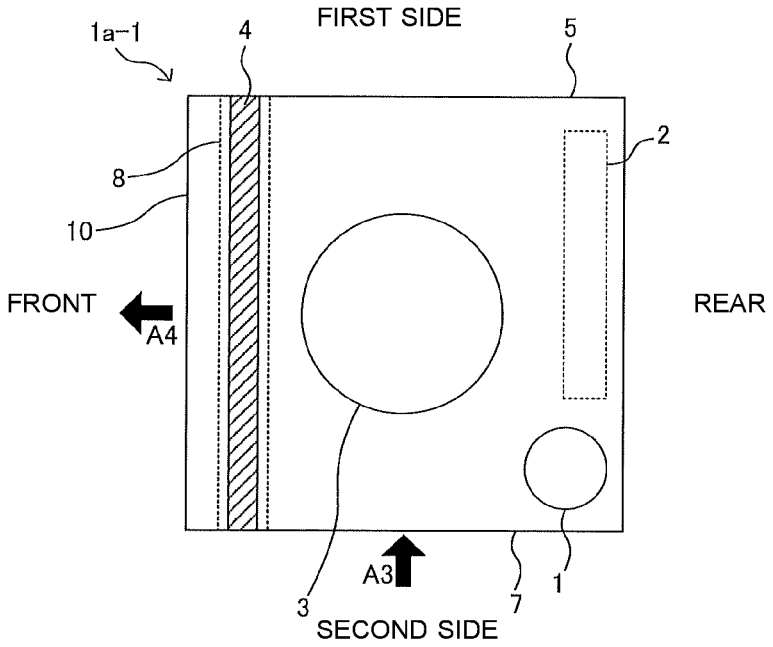
FIG. 6 is a schematic top view schematically illustrating a state in which an example of the heat source device that is one type of the heat exchange unit according to Embodiment 1 of the present disclosure is viewed from the top.
Figure 7:
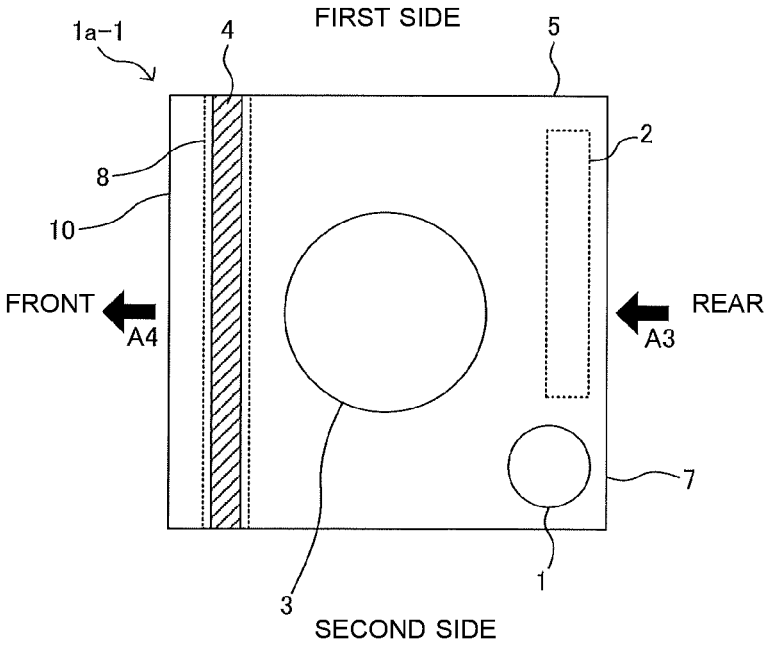
FIG. 7 is a schematic top view schematically illustrating a state in which another example of the heat source device that is one type of the heat exchange unit according to Embodiment 1 of the present disclosure is viewed from the top.
Figure 8:
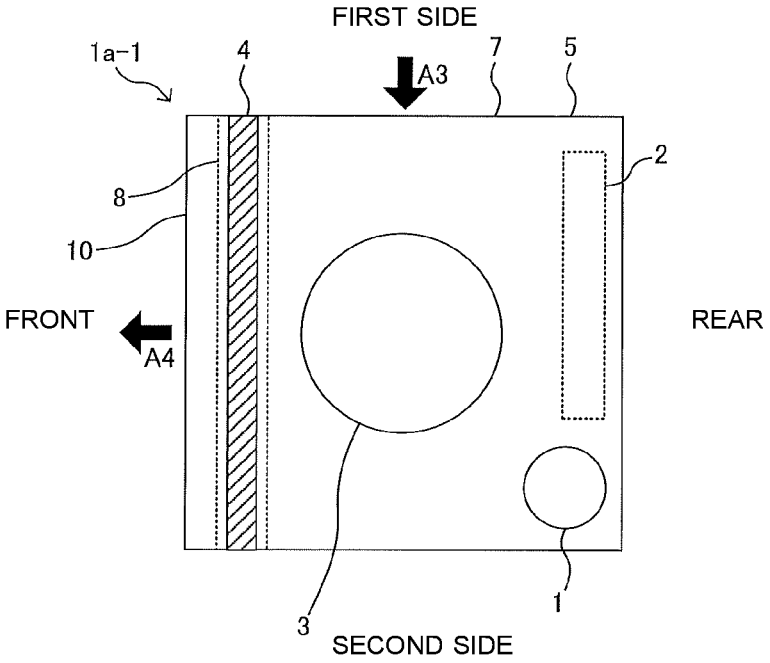
FIG. 8 is a schematic top view schematically illustrating a state in which still another example of the heat source device that is one type of the heat exchange unit according to Embodiment 1 of the present disclosure is viewed from the top.

FIG. 6 is a schematic top view schematically illustrating a state in which an example of the heat source device 1*a*-1 is viewed from the top. FIG. 7 is a schematic top view schematically illustrating a state in which another example of the heat source device 1*a*-1 is viewed from the top. FIG. 8 is a schematic top view schematically illustrating a state in which still another example of the heat source device 1*a*-1 is viewed from the top. Note that FIG. 6 to FIG. 8 schematically illustrate the inside of the heat source device 1*a*-1. Further, in FIG. 6 to FIG. 8, airflows are shown by an arrow A3 and an arrow A4. Further, FIG. 6 to FIG. 8 illustrate an exemplary state in which the right in the drawing sheet is the rear surface of the heat source device 1*a*-1, the left in the drawing sheet is the front surface of the heat source device 1*a*-1, the top in the drawing sheet is a first side surface of the heat source device 1*a*-1, and the bottom in the drawing sheet is a second side surface of the heat source device 1*a*-1.

In the housing 5 illustrated in FIG. 6, the air inlet 7 is formed at the second side surface of the housing 5 and the air outlet 10 is formed at the front surface of the housing 5. In this case, as shown by the arrow A3 in FIG. 6, air is taken in from the second side surface of the housing 5, flows through the bellmouth 40, the centrifugal fan 3, and the heat exchanger 4, and is blown from the front surface of the housing 5.

In the housing 5 illustrated in FIG. 7, the air inlet 7 is formed at the rear surface of the housing 5 and the air outlet 10 is formed at the front surface of the housing 5. In this case, as shown by the arrow A3 in FIG. 7, air is taken in from the rear surface of the housing 5, flows through the bellmouth 40, the centrifugal fan 3, and the heat exchanger 4, and is blown from the front surface of the housing 5.

In the housing 5 illustrated in FIG. 8, the air inlet 7 is formed at the first side surface of the housing 5 and the air outlet 10 is formed at the front surface of the housing 5. In this case, as shown by the arrow A3 in FIG. 8, air is taken in from the first side surface of the housing 5, flows through the bellmouth 40, the centrifugal fan 3, and the heat exchanger 4, and is blown from the front surface of the housing 5.

Note that each of the air inlet 7 and the air outlet 10 may be used in an open system but, for example, a duct may be connected thereto. Further, the heat source device 1*a*-1 may be any type of heat source device out of a floor-standing type, a ceiling-suspended type, and a ceiling-concealed type. In the ceiling-concealed type, fan efficiency can be increased and the housing 5 can be reduced in thickness by using the centrifugal fan 3. Note that the open system means that each of the air inlet 7 and the air outlet 10 is open to a space outside the housing 5 without intervention of, for example, a duct.

Next, the heat exchanger 4 is described.

Figure 9:
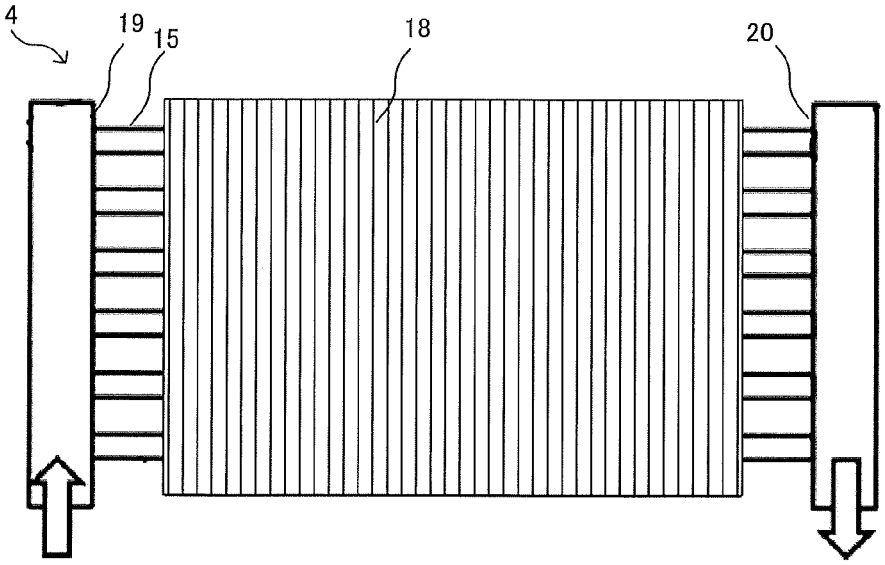
FIG. 9 is a schematic view illustrating an example of a heat exchanger mounted on the heat source device that is one type of the heat exchange unit according to Embodiment 1 of the present disclosure.
Figure 10:
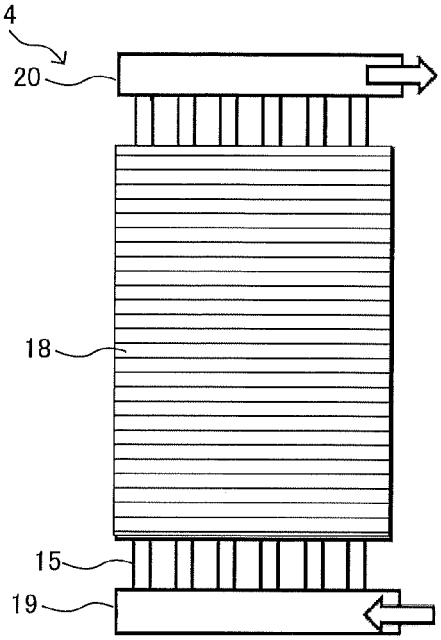
FIG. 10 is a schematic view illustrating another example of the heat exchanger mounted on the heat source device that is one type of the heat exchange unit according to Embodiment 1 of the present disclosure.
Figure 11:
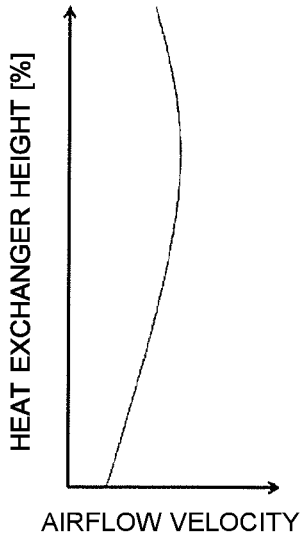
FIG. 11 is a graph illustrating an example of airflow velocity distribution of a centrifugal fan when the heat exchanger illustrated in FIG. 10 is mounted.

FIG. 9 is a schematic view illustrating an example of the heat exchanger 4 mounted on the heat source device 1*a*-1. FIG. 10 is a schematic view illustrating another example of the heat exchanger 4 mounted on the heat source device 1*a*-1. FIG. 11 is a graph illustrating an example of airflow velocity distribution of the centrifugal fan 3 when the heat exchanger 4 illustrated in FIG. 10 is mounted. Note that the arrows illustrated in FIG. 9 and FIG. 10 represent examples of a refrigerant flow when the heat exchanger 4 is used as, for example, an evaporator. Further, in FIG. 11, the vertical axis is a heat exchanger height and the horizontal axis is an airflow velocity.

As illustrated in FIG. 9 and FIG. 10, the heat exchanger 4 includes a plurality of heat transfer tubes 15, a plurality of fins 18, a refrigerant distribution pipe 19, and a refrigerant collection pipe 20.

The plurality of heat transfer tubes 15 are provided side by side and inserted through the plurality of fins 18. The heat transfer tube 15 may be a circular tube or a flat tube.

The plurality of fins 18 are provided side by side at a constant pitch and the plurality of heat transfer tubes 15 are inserted therethrough.

The refrigerant distribution pipe 19 is connected to the plurality of heat transfer tubes 15 and distributes refrigerant to the heat transfer tubes 15.

The refrigerant collection pipe 20 is connected to the plurality of heat transfer tubes 15 and joins streams of refrigerant flowing through the heat transfer tubes 15.

Refrigerant whose pressure is reduced by a pressure reducing device, which is one of the devices of the refrigerant circuit, flows into the refrigerant distribution pipe 19 and is distributed to the plurality of heat transfer tubes 15 by the refrigerant distribution pipe 19. The refrigerant flowing through each of the plurality of heat transfer tubes 15 exchanges heat with air at portions connected to the fins and flows into the refrigerant collection pipe 20. Streams of the refrigerant flowing into the refrigerant collection pipe 20 are joined and flow out through an outlet of the refrigerant collection pipe 20. The refrigerant flowing out of the refrigerant collection pipe 20 is sucked into the compressor 1, which is one of the devices of the refrigerant circuit. The refrigerant sucked into the compressor 1 is compressed and discharged. The refrigerant discharged from the compressor 1 flows into and exchanges heat in a condenser, which is one of the devices of the refrigerant circuit. Then, the pressure is reduced by the pressure reducing device. In this manner, the refrigerant circulates through the refrigerant circuit.

FIG. 9 illustrates a case where the heat transfer tubes 15 are provided side by side in a horizontal direction but the manner of provision of the heat transfer tubes 15 is not limited thereto. For example, as illustrated in FIG. 10, the heat transfer tubes 15 may be provided side by side in a vertical direction. The heat exchanger 4 illustrated in FIG. 10 is less affected by the airflow velocity distribution of the centrifugal fan 3 in a height direction of the heat exchanger 4. Thus, heat exchange efficiency can be improved. That is, as illustrated in FIG. 11, imbalance in the airflow velocity can be reduced in the height direction of the heat exchanger 4 and the heat exchange efficiency can be improved accordingly.

Next, the heat transfer tubes 15 are described.

Figure 12:
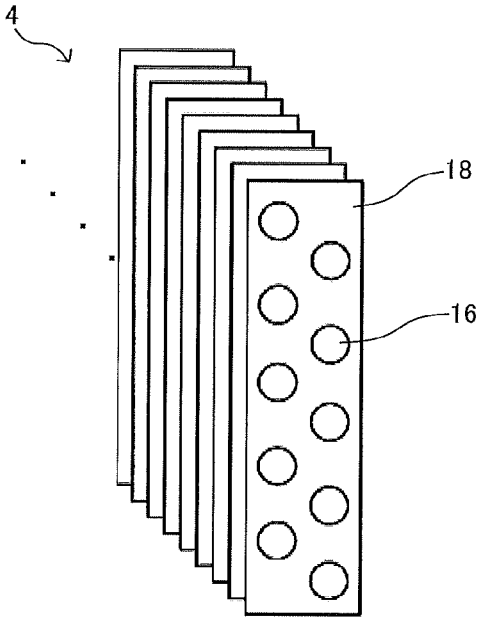
FIG. 12 is a perspective view schematically illustrating a part of a heat exchanger that uses circular tubes as heat transfer tubes.
Figure 13:
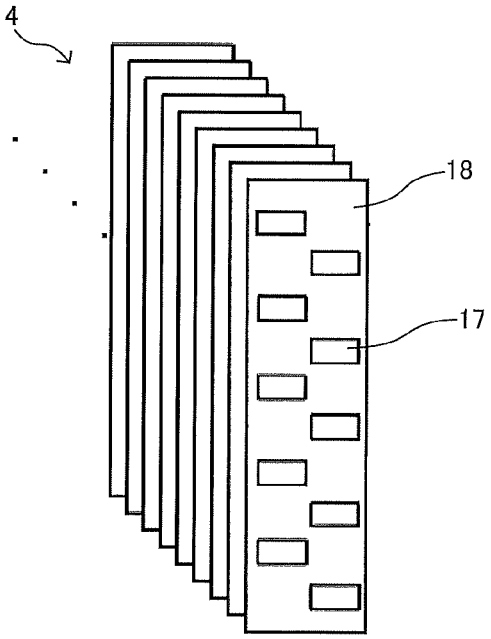
FIG. 13 is a perspective view schematically illustrating a part of a heat exchanger that uses flat tubes as heat transfer tubes.

FIG. 12 is a perspective view schematically illustrating a part of a heat exchanger 4 that uses circular tubes 16 as the heat transfer tubes 15. FIG. 13 is a perspective view schematically illustrating a part of a heat exchanger 4 that uses flat tubes 17 as the heat transfer tubes 15.

In the heat exchanger 4 illustrated in FIG. 12, the circular tubes 16 are used as the heat transfer tubes 15. In this case, for example, the circular tubes 16 may be arranged in a staggered manner as illustrated in FIG. 12. Alternatively, the circular tubes 16 may be disposed in an array or may be disposed in three or more arrays.

In the heat exchanger 4 illustrated in FIG. 13, the flat tubes 17 are used as the heat transfer tubes 15. In this case, for example, the flat tubes 17 may be arranged in a staggered manner as illustrated in FIG. 13. Alternatively, the flat tubes 17 may be disposed in an array or may be disposed in three or more arrays. In the same volume, the heat transfer area of the flat tube 17 is larger than that of the circular tube 16. Therefore, the heat exchanger 4 that uses the flat tubes 17 can be mounted on a thin heat source device or a thin indoor unit having a strict restriction on the height dimension and have a further improved heat exchange efficiency.

Next, modification examples of the heat exchanger 4 are described.

Figure 14:
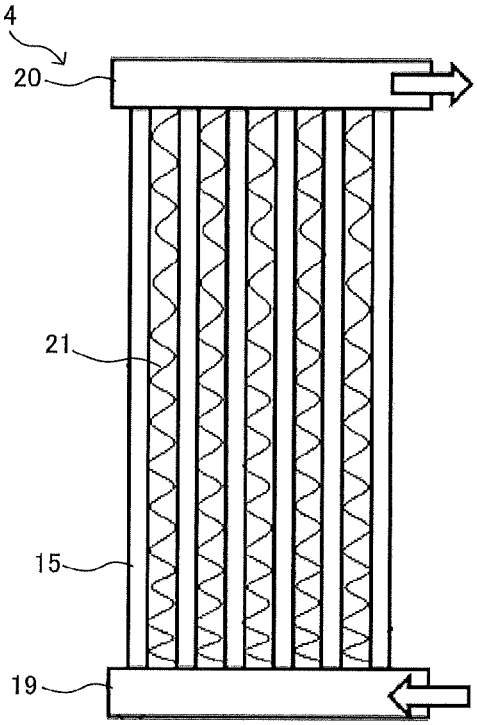
FIG. 14 is a schematic view schematically illustrating an example of the structure of a heat exchanger that uses corrugated fins.
Figure 15:
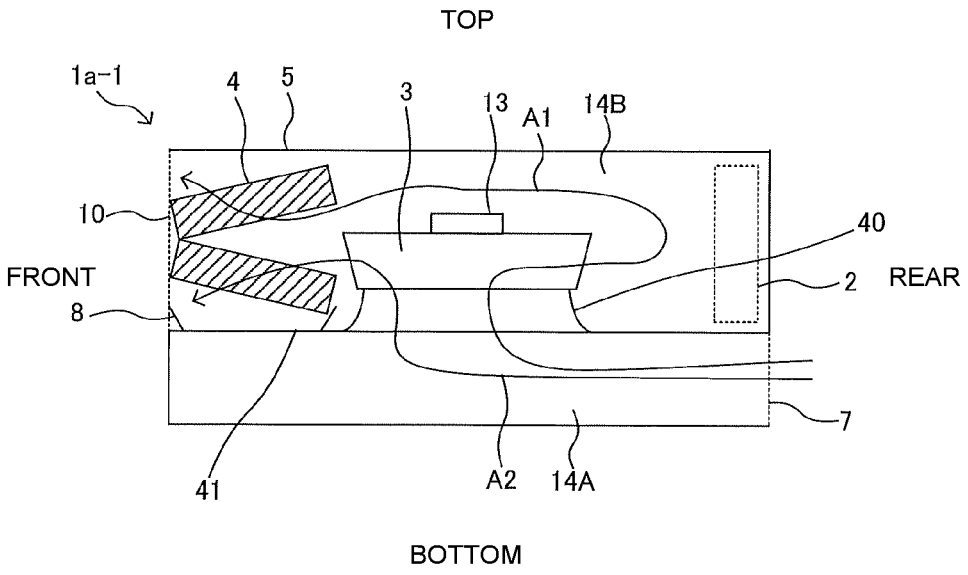
FIG. 15 is a schematic sectional view schematically illustrating an example of the heat exchanger in association with the cross section taken along the line A-A in FIG. 1.
Figure 16:
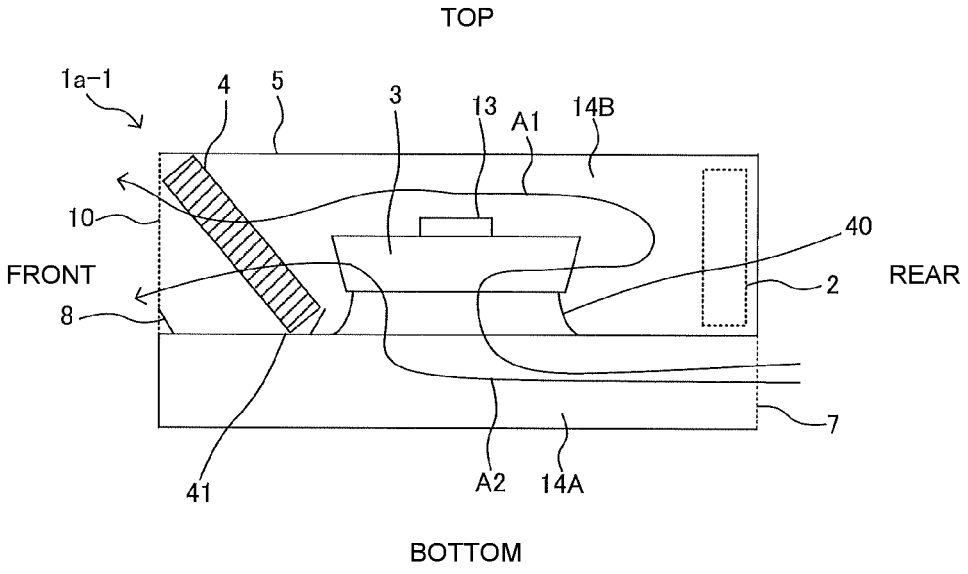
FIG. 16 is a schematic sectional view schematically illustrating another example of the heat exchanger in association with the cross section taken along the line A-A in FIG. 1.
Figure 17:
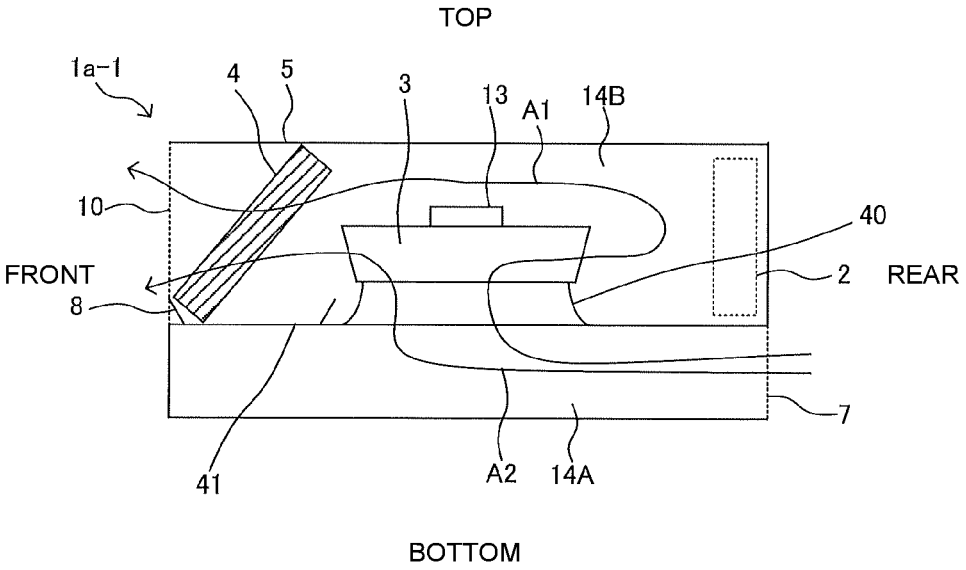
FIG. 17 is a schematic sectional view schematically illustrating still another example of the heat exchanger in association with the cross section taken along the line A-A in FIG. 1.

FIG. 14 is a schematic view schematically illustrating an example of the structure of a heat exchanger 4 that uses corrugated fins 21. FIG. 15 is a schematic sectional view schematically illustrating an example of the heat exchanger 4 in association with the cross section taken along the line A-A in FIG. 1. FIG. 16 is a schematic sectional view schematically illustrating another example of the heat exchanger 4 in association with the cross section taken along the line A-A in FIG. 1. FIG. 17 is a schematic sectional view schematically illustrating still another example of the heat exchanger 4 in association with the cross section taken along the line A-A in FIG. 1.

FIG. 9 and FIG. 10 each illustrates the exemplary heat exchanger 4 that uses the plate-shaped fins 18. FIG. 14 illustrates the exemplary heat exchanger 4 that uses the corrugated fins 21. The heat exchanger 4 that uses the corrugated fins 21 can be obtained at low costs, can attain high heat transfer performance, can be mounted on a thin heat source device or a thin indoor unit having a strict restriction on the height dimension, and can have a further improved heat exchange efficiency.

FIG. 2 to FIG. 4 illustrate the exemplary case where the heat exchanger 4 is vertically disposed in the housing 5 but the heat exchanger 4 is not limited thereto.

For example, two heat exchange portions of a heat exchanger 4 may be disposed at different inclination angles as illustrated in FIG. 15. FIG. 15 illustrates a case where the heat exchanger 4 is disposed in a horizontally tilted V-shape in cross section with the lower heat exchange portion being inclined so that a part closer to the air outlet 10 is located higher than a part closer to the centrifugal fan 3 and with the upper heat exchange portion being inclined so that a part closer to the centrifugal fan 3 is located higher than a part closer to the air outlet 10.

By disposing the heat exchanger 4 as illustrated in FIG. 15, the heat exchanger can be mounted with high density under a strict height restriction in the housing 5. Therefore, the heat exchange efficiency can be improved through the disposition of FIG. 15. Further, through the disposition of FIG. 15, the heat exchanger can be mounted with high density and the distance between the blade tip of the centrifugal fan 3 and the heat exchanger 4 can be secured. That is, the distance can be increased and an advantage can be expected in that abnormal sound or noise is reduced.

Further, one heat exchanger 4 may be inclined as illustrated in FIG. 16. FIG. 16 illustrates a case where the heat exchanger 4 is inclined so that a part closer to the air outlet 10 is located higher than a part closer to the centrifugal fan 3.

By inclining the heat exchanger 4 as illustrated in FIG. 16, the heat exchanger can be mounted with high density under a strict height restriction in the housing 5. Therefore, the heat exchange efficiency can be improved through the disposition of FIG. 16.

Further, one heat exchanger 4 may be inclined as illustrated in FIG. 17. FIG. 17 illustrates a case where the heat exchanger 4 is inclined so that a part closer to the centrifugal fan 3 is located higher than a part closer to the air outlet 10.

By inclining the heat exchanger 4 as illustrated in FIG. 17, the heat exchanger can be mounted with high density under a strict height restriction in the housing 5. Therefore, the heat exchange efficiency can be improved through the disposition of FIG. 17.

As illustrated in FIG. 16 and FIG. 17, the inclination angle and the inclination direction of the heat exchanger 4 may be selected depending on the height position of the centrifugal fan 3 so that the distance between the blade tip of the centrifugal fan 3 and the heat exchanger 4 can be secured.

Further, the vertical disposition of the heat exchanger 4 means that the heat exchanger 4 is disposed with its air passing surface running in a direction orthogonal to the partition plate 41.

Further, the inclination of the heat exchanger 4 means that the heat exchanger 4 is disposed with its air passing surface running in a direction oblique to the partition plate 41.

Note that FIG. 1 to FIG. 17 each illustrates the exemplary heat source device 1*a*-1 including the compressor 1 but the presence or absence of the compressor 1 and the control box 2, the disposition of the compressor 1 and the control box 2, and the layout of the drain pan 8 are not limited to those in the figures.

Embodiment 2

Embodiment 2 of the present disclosure is described below. In Embodiment 2, description overlapping that of Embodiment 1 is omitted and parts identical or corresponding to those in Embodiment 1 are shown by the same reference signs.

Figure 18:
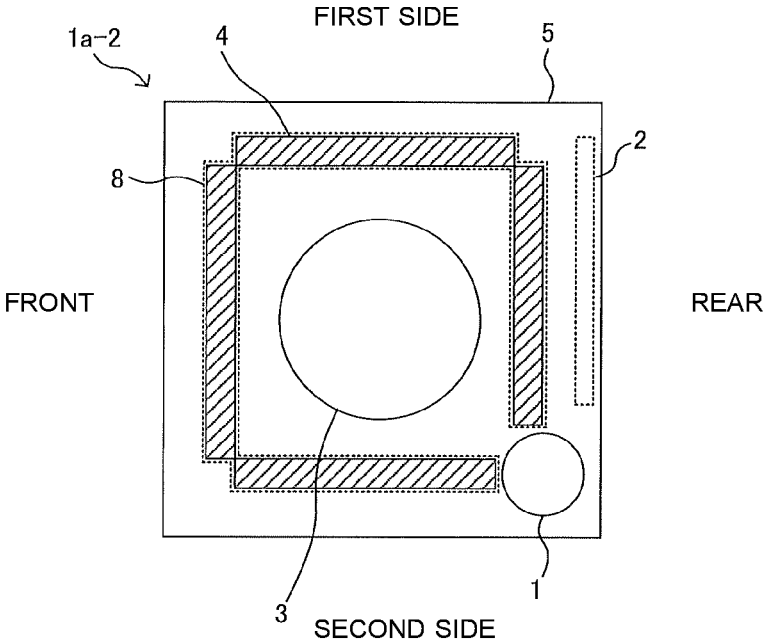
FIG. 18 is a schematic top view schematically illustrating a state in which a heat source device that is one type of a heat exchange unit according to Embodiment 2 of the present disclosure is viewed from the top.

FIG. 18 is a schematic top view schematically illustrating a state in which a heat source device 1*a*-2 that is one type of a heat exchange unit according to Embodiment 2 of the present disclosure is viewed from the top. The heat source device 1*a*-2 is described below with reference to FIG. 18. Note that FIG. 18 schematically illustrates the inside of the heat source device 1*a*-2. Further, FIG. 18 illustrates an exemplary state in which the right in the drawing sheet is the rear surface of the heat source device 1*a*-2, the left in the drawing sheet is the front surface of the heat source device 1*a*-2, the top in the drawing sheet is a first side surface of the heat source device 1*a*-2, and the bottom in the drawing sheet is a second side surface of the heat source device 1*a*-2.

Embodiment 1 is directed to the exemplary case where the heat exchanger 4 faces the front surface of the heat source device 1*a*-1. In Embodiment 2, heat exchangers 4 are disposed around the centrifugal fan 3. Further, in Embodiment 1, the air outlet 10 is formed at a downstream position relative to the heat exchangers 4, that is, at the front surface of the heat source device 1*a*-1. In Embodiment 2, the air outlet 10 can be formed at any side.

Specifically, the heat exchangers 4 face the rear surface of the heat source device 1*a*-2, the front surface of the heat source device 1*a*-2, the first side surface of the heat source device 1*a*-2, and the second side surface of the heat source device 1*a*-2. By disposing the heat exchangers 4 around the centrifugal fan 3, the air outlet 10 can be formed on at least one side out of the rear surface of the heat source device 1*a*-2, the front surface of the heat source device 1*a*-2, the first side surface of the heat source device 1*a*-2, and the second side surface of the heat source device 1*a*-2. Therefore, according to the heat source device 1*a*-2, the heat exchangers 4 can be mounted with high density and the heat exchange efficiency can be improved.

Further, an experiment and analysis conducted by the inventors demonstrate that it is important to increase the front surface area of the heat exchanger in order that the heat exchanger be efficiently mounted in a thin housing with its height dimension being smallest among the height, width, and depth dimensions of the housing. That is, by increasing the front surface area of the heat exchanger, the resistance of air passing through the heat exchanger can be reduced and the airflow rate when the centrifugal fan 3 is rotated at an arbitrary rotation speed can be increased.

Therefore, by disposing the heat exchangers 4 around the centrifugal fan 3, the heat exchange efficiency can effectively be improved compared with a case where the heat transfer area when heat exchangers are mounted is increased by increasing a pitch of an array of the heat exchangers or disposing the heat exchangers in multiple arrays. Thus, the disposition of the heat exchangers 4 around the centrifugal fan 3 leads to the increase in the front surface area of the heat exchangers 4. Accordingly, the degree of freedom in terms of disposition of the air outlet 10 can be increased and the heat exchange efficiency can be improved effectively.

Figure 19:
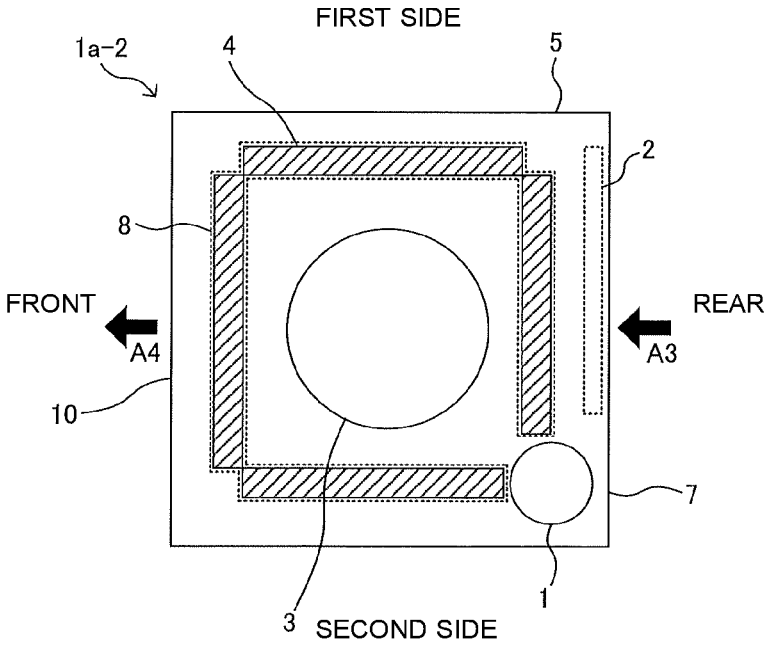
FIG. 19 is a schematic top view schematically illustrating a state in which an example of the heat source device that is one type of the heat exchange unit according to Embodiment 2 of the present disclosure is viewed from the top.
Figure 20:
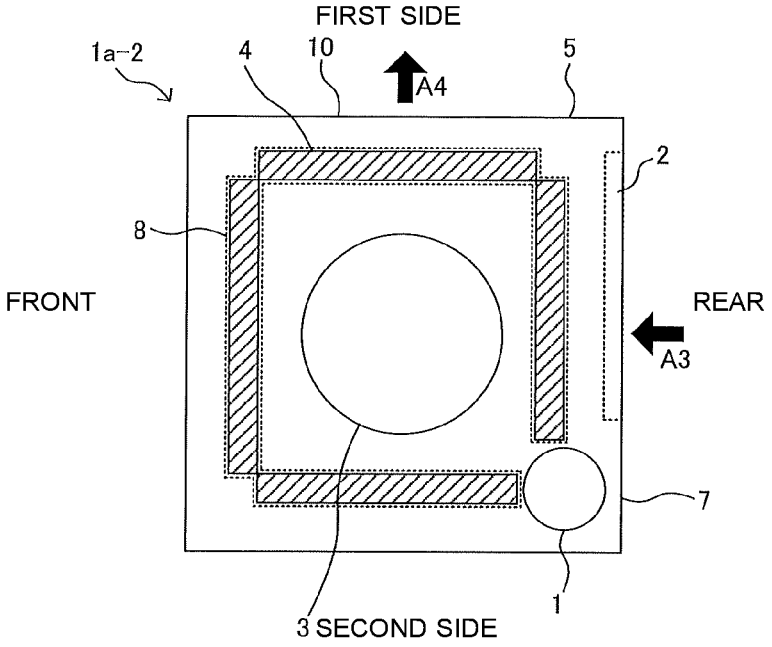
FIG. 20 is a schematic top view schematically illustrating a state in which another example of the heat source device that is one type of the heat exchange unit according to Embodiment 2 of the present disclosure is viewed from the top.
Figure 21:
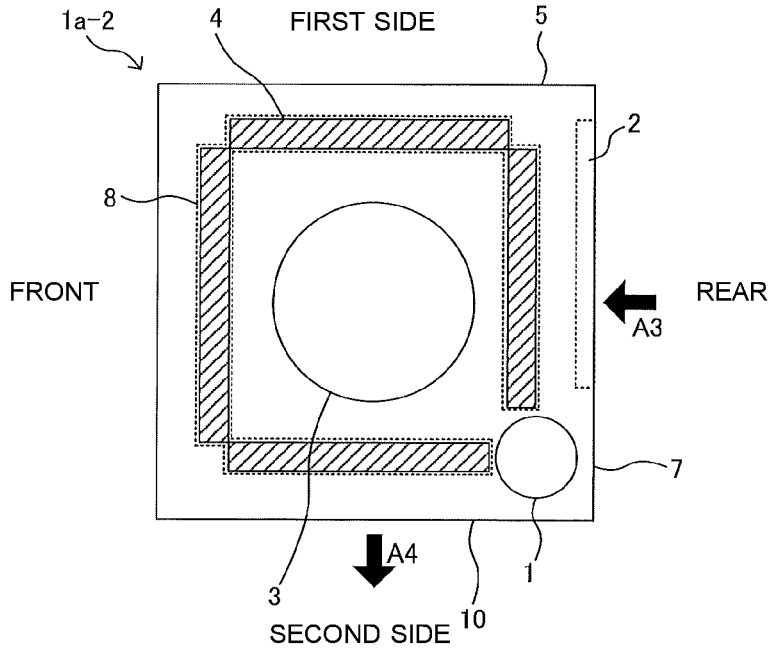
FIG. 21 is a schematic top view schematically illustrating a state in which still another example of the heat source device that is one type of the heat exchange unit according to Embodiment 2 of the present disclosure is viewed from the top.
Figure 22:
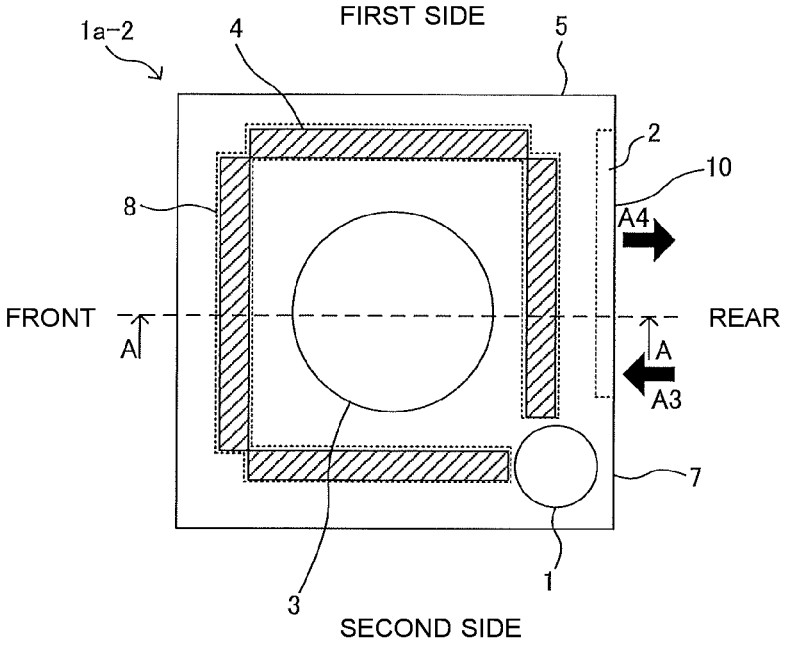
FIG. 22 is a schematic top view schematically illustrating a state in which still another example of the heat source device that is one type of the heat exchange unit according to Embodiment 2 of the present disclosure is viewed from the top.

Here, description is made of a case where airflows are viewed from the top. FIG. 19 is a schematic top view schematically illustrating a state in which an example of the heat source device 1*a*-2 is viewed from the top. FIG. 20 is a schematic top view schematically illustrating a state in which another example of the heat source device 1*a*-2 is viewed from the top. FIG. 21 is a schematic top view schematically illustrating a state in which still another example of the heat source device 1*a*-2 is viewed from the top. FIG. 22 is a schematic top view schematically illustrating a state in which still another example of the heat source device 1*a*-2 is viewed from the top. FIG. 19 to FIG. 22 each illustrates an exemplary case where the air inlet 7 is formed at the rear surface of the housing 5.

Note that FIG. 19 to FIG. 22 schematically illustrate the inside of the heat source device 1*a*-2. Further, in FIG. 19 to FIG. 22, airflows are shown by the arrow A3 and the arrow A4. Further, FIG. 19 to FIG. 22 each illustrates an exemplary state in which the right in the drawing sheet is the rear surface of the heat source device 1*a*-2, the left in the drawing sheet is the front surface of the heat source device 1*a*-2, the top in the drawing sheet is the first side surface of the heat source device 1*a*-2, and the bottom in the drawing sheet is the second side surface of the heat source device 1*a*-2.

In the housing 5 illustrated in FIG. 19, the air inlet 7 is formed at the rear surface of the housing 5 and the air outlet 10 is formed at the front surface of the housing 5. In this case, as shown by the arrow A3 in FIG. 19, air is taken in from the rear surface of the housing 5, flows through the bellmouth 40, the centrifugal fan 3, and the heat exchangers 4, and is blown from the front surface of the housing 5.

In the housing 5 illustrated in FIG. 20, the air inlet 7 is formed at the rear surface of the housing 5 and the air outlet 10 is formed at the first side surface of the housing 5. In this case, as shown by the arrow A3 in FIG. 20, air is taken in from the rear surface of the housing 5, flows through the bellmouth 40, the centrifugal fan 3, and the heat exchangers 4, and is blown from the first side surface of the housing 5.

In the housing 5 illustrated in FIG. 21, the air inlet 7 is formed at the rear surface of the housing 5 and the air outlet 10 is formed at the second side surface of the housing 5. In this case, as shown by the arrow A3 in FIG. 21, air is taken in from the rear surface of the housing 5, flows through the bellmouth 40, the centrifugal fan 3, and the heat exchangers 4, and is blown from the second side surface of the housing 5.

In the housing 5 illustrated in FIG. 22, the air inlet 7 is formed at the rear surface of the housing 5 and the air outlet 10 is formed at the rear surface of the housing 5. In this case, as shown by the arrow A3 in FIG. 22, air is taken in from the rear surface of the housing 5, flows through the bellmouth 40, the centrifugal fan 3, and the heat exchangers 4, and is blown from the rear surface of the housing 5.

By disposing the heat exchangers 4 so that the heat exchangers 4 face the four sides of the housing 5 as described above, the air outlet 10 can be disposed at any side and the degree of freedom in terms of disposition of the air outlet 10 can be improved greatly. Further, the air outlet 10 need not essentially be disposed at any one side but air outlets 10 may be disposed at a plurality of sides or all sides as necessary. Further, the air inlet 7 may be provided at a side having the largest area among the four sides that are the front surface, the first side surface, the second side surface, and the rear surface of the housing 5. In this case, the air passage resistance of the air inlet 7 is further reduced.

Figure 23:
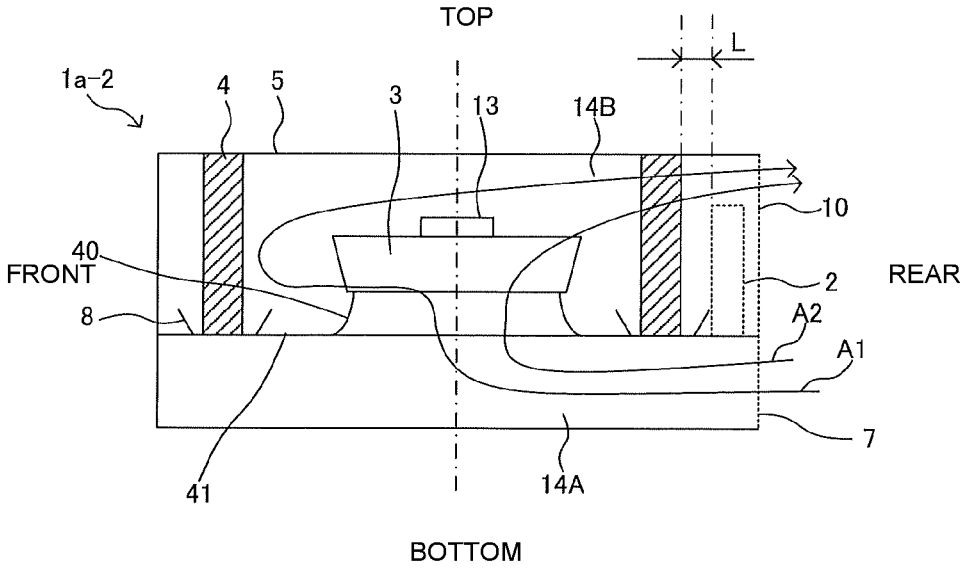
FIG. 23 is a schematic sectional view schematically illustrating an example of a cross section taken along the line A-A in FIG. 22.

Here, description is made of a case where airflows are viewed from the side. FIG. 23 is a schematic sectional view schematically illustrating an example of a cross section taken along the line A-A in FIG. 22. Note that, in FIG. 23, airflows are shown by the arrow A1 and the arrow A2. Further, FIG. 23 illustrates an exemplary state in which the right in the drawing sheet is the rear surface of the heat source device 1*a*-2 and the left in the drawing sheet is the front surface of the heat source device 1*a*-2.

As illustrated in FIG. 23, it is appropriate that the control box 2 be low in height so as not to block the air outlet 10. That is, it is appropriate that the height of the control box 2 be smaller than the height of the opening of the air outlet 10. Further, an analysis conducted by the inventors demonstrates that a loss is reduced when the heat exchanger 4 and the control box 2 are located away from each other by at least 50 mm. Therefore, it is appropriate that a distance L between the heat exchanger 4 and the control box 2 be 50 mm or longer, preferably 100 mm or longer.

Next, modification examples of the disposition of the heat exchangers 4 are described.

Figure 24:
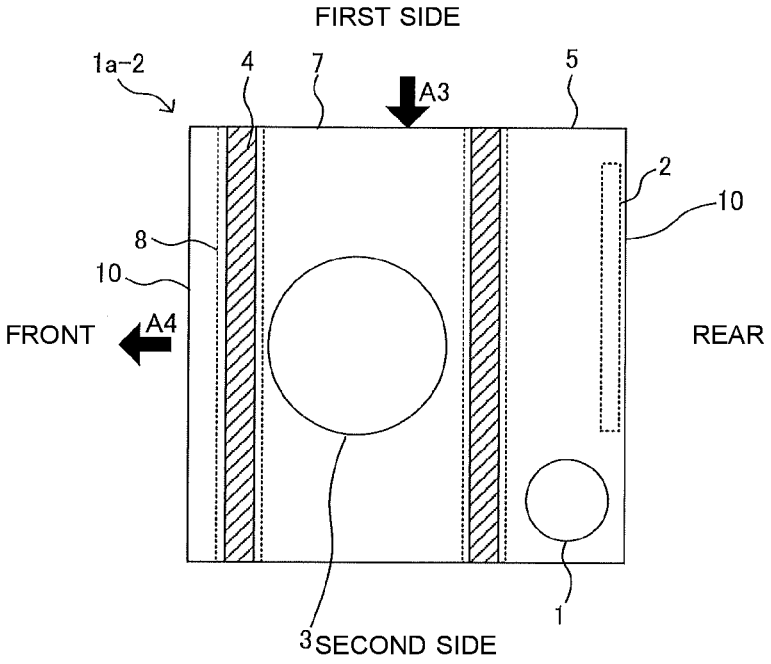
FIG. 24 is a schematic top view schematically illustrating a state in which an example of the heat source device that is one type of the heat exchange unit according to Embodiment 2 of the present disclosure is viewed from the top.
Figure 25:
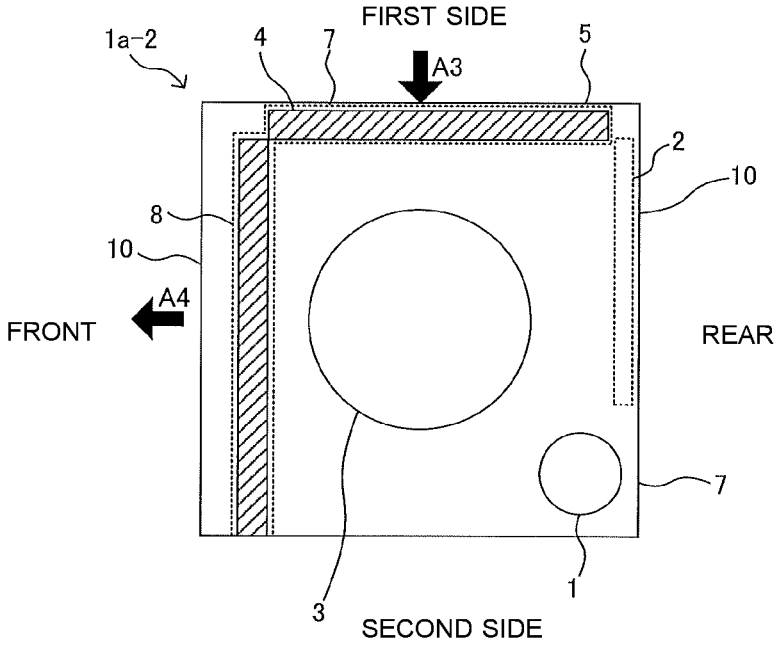
FIG. 25 is a schematic top view schematically illustrating a state in which another example of the heat source device that is one type of the heat exchange unit according to Embodiment 2 of the present disclosure is viewed from the top.
Figure 26:
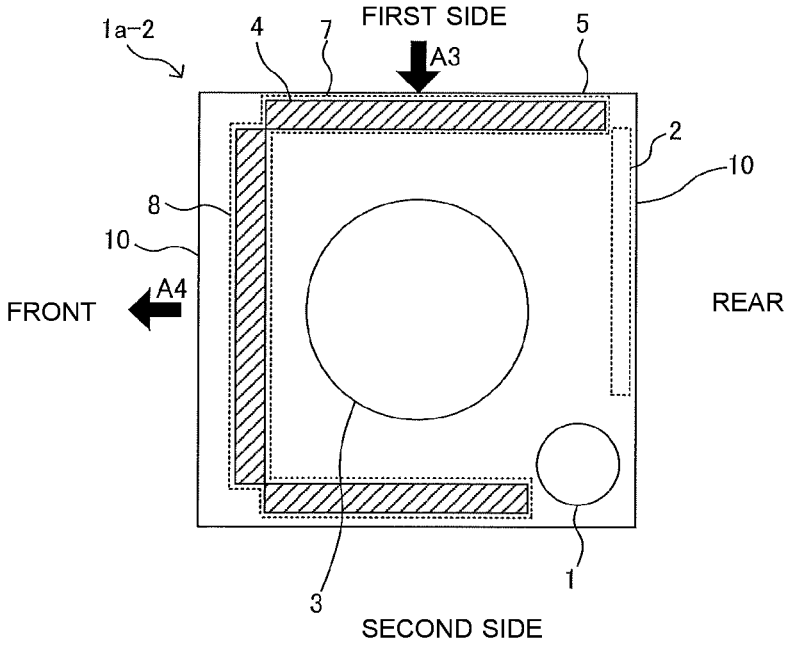
FIG. 26 is a schematic top view schematically illustrating a state in which still another example of the heat source device that is one type of the heat exchange unit according to Embodiment 2 of the present disclosure is viewed from the top.

FIG. 24 is a schematic top view schematically illustrating a state in which an example of the heat source device 1*a*-2 is viewed from the top. FIG. 25 is a schematic top view schematically illustrating a state in which another example of the heat source device 1*a*-2 is viewed from the top. FIG. 26 is a schematic top view schematically illustrating a state in which still another example of the heat source device 1*a*-2 is viewed from the top. Note that FIG. 24 to FIG. 26 illustrate an exemplary case where the air inlet 7 is formed at the first side surface of the housing 5 and the air outlet 10 is formed at the front surface of the housing 5.

FIG. 19 to FIG. 23 each illustrates the exemplary case where the heat exchangers 4 are disposed around the centrifugal fan 3 at positions where the heat exchangers 4 face the four sides of the housing 5 but the heat exchangers 4 are not limited thereto. For example, the heat exchangers 4 may be disposed at positions where the heat exchangers 4 face two sides of the housing 5 as illustrated in FIG. 24 or FIG. 25 or may be disposed at positions where the heat exchangers 4 face three sides of the housing 5 as illustrated in FIG. 26.

When the heat exchangers 4 are disposed at two sides as illustrated in FIG. 24 or FIG. 25, the air outlet 10 can be disposed at the two sides. That is, in FIG. 24, the air outlet 10 can be disposed at the front surface and rear surface of the housing 5. Further, in FIG. 25, the air outlet 10 can be disposed at the front surface and the first side surface of the housing 5.

When the heat exchangers 4 are disposed at three sides as illustrated in FIG. 26, the air outlet 10 can be disposed at the three sides. That is, in FIG. 26, the air outlet 10 can be disposed at the front surface, the first side surface, and the second side surface of the housing 5.

As described above, the degree of freedom in terms of disposition of the air outlet 10 increases as the number of disposed heat exchangers 4 increases. Note that, when the heat exchangers 4 are disposed at two or three sides, the air passage resistance can be reduced by disposing the heat exchangers 4 at sides where the control box 2 and the compressor 1 are not disposed.

Note that FIG. 18 to FIG. 26 each illustrates the exemplary heat source device 1*a*-2 including the compressor 1 but the presence or absence of the compressor 1 and the control box 2, the disposition of the compressor 1 and the control box 2, and the layout of the drain pan 8 are not limited to those in the figures.

Embodiment 3

Embodiment 3 of the present disclosure is described below. In Embodiment 3, the same description as that of Embodiment 1 and Embodiment 2 is omitted and parts identical or corresponding to those in Embodiment 1 and Embodiment 2 are shown by the same reference signs.

Figure 27:
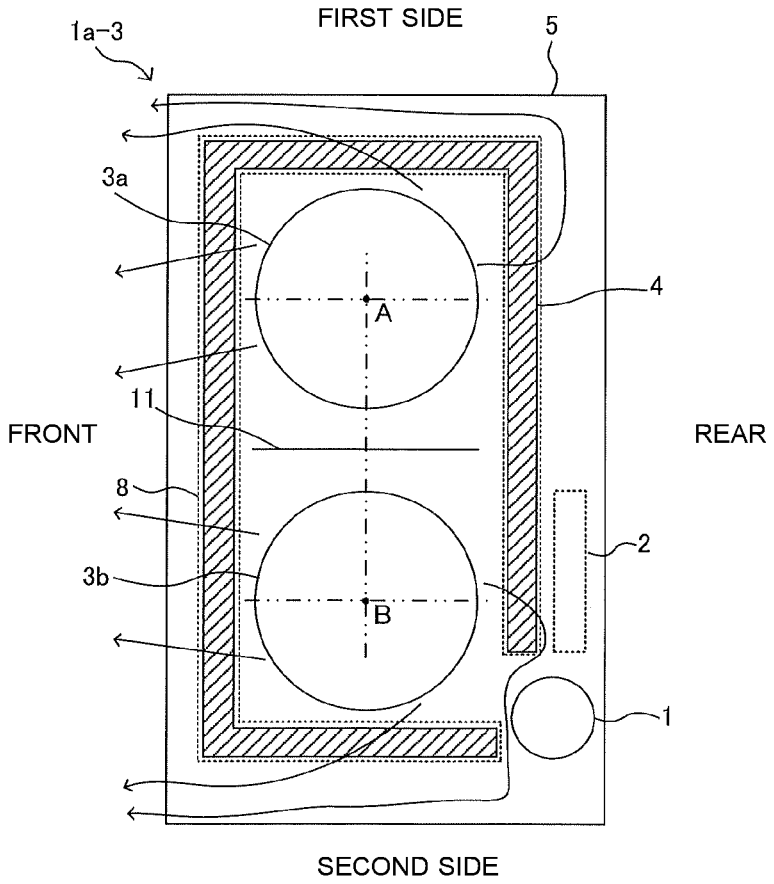
FIG. 27 is a schematic top view schematically illustrating a state in which an example of a heat source device that is one type of a heat exchange unit according to Embodiment 3 of the present disclosure is viewed from the top.
Figure 28:
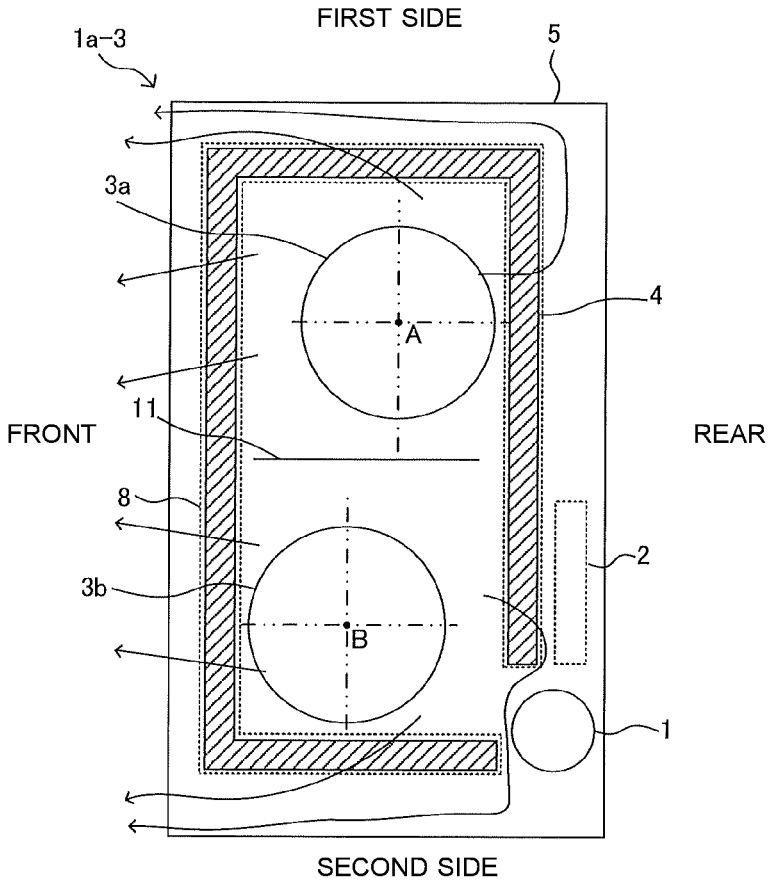
FIG. 28 is a schematic top view schematically illustrating a state in which another example of the heat source device that is one type of the heat exchange unit according to Embodiment 3 of the present disclosure is viewed from the top.

FIG. 27 is a schematic top view schematically illustrating a state in which an example of a heat source device 1*a*-3 that is one type of a heat exchange unit according to Embodiment 3 of the present disclosure is viewed from the top. FIG. 28 is a schematic top view schematically illustrating a state in which another example of the heat source device 1*a*-3 is viewed from the top. The heat source device 1*a*-3 is described below with reference to FIG. 27 and FIG. 28. Note that FIG. 27 and FIG. 28 each schematically illustrates the inside of the heat source device 1*a*-3. Further, FIG. 27 and FIG. 28 each illustrates an exemplary state in which the right in the drawing sheet is the rear surface of the heat source device 1*a*-3, the left in the drawing sheet is the front surface of the heat source device 1*a*-3, the top in the drawing sheet is a first side surface of the heat source device 1*a*-3, and the bottom in the drawing sheet is a second side surface of the heat source device 1*a*-3. Further, in FIG. 27 and FIG. 28, airflows are shown by arrows.

Embodiment 1 and Embodiment 2 are directed to the exemplary case where one centrifugal fan 3 is disposed in the housing 5. In Embodiment 3, a plurality of centrifugal fans 3 are disposed in the housing 5. FIG. 27 and FIG. 28 each illustrates that one of the plurality of centrifugal fans 3 that is located at the top in the drawing sheet is referred to as a first centrifugal fan 3*a* and the other one of the plurality of centrifugal fans 3 that is located at the bottom in the drawing sheet is referred to as a second centrifugal fan 3*b*.

Even in a case of a housing 5 having a rectangular shape in top view, high performance can be attained by providing a plurality of centrifugal fans 3. In the case of the housing 5 having the rectangular shape in top view as illustrated in FIG. 27 and FIG. 28, it is appropriate that the first centrifugal fan 3*a* and the second centrifugal fan 3*b* be disposed in the housing 5 so that the first centrifugal fan 3*a* and the second centrifugal fan 3*b* are arranged in a long-side direction, that is, side by side in a width direction.

Further, when the plurality of centrifugal fans 3 are provided, it is appropriate that a fan-to-fan partition plate 11 be provided between the centrifugal fans 3. By providing the fan-to-fan partition plate 11, interference between the centrifugal fans 3 can be suppressed.

The fan-to-fan partition plate 11 corresponds to a "third partition plate". Further, when the housing 5 has the rectangular shape in top view as illustrated in FIG. 27 and FIG. 28, an air passage blocking a portion of the control box 2 at the rear surface of the housing 5 can be reduced relatively. In addition, the heat exchangers 4 can be mounted in the width direction of the housing 5 along with the increase in width.

Note that the rotational directions of the plurality of centrifugal fans 3 are not particularly limited but interference between airflows of the centrifugal fans 3 can be suppressed and energy efficiency can be improved when the centrifugal fans 3 rotate in opposite directions.

FIG. 27 illustrates an exemplary case where the first centrifugal fan 3*a* and the second centrifugal fan 3*b* are disposed so that a central point of the first centrifugal fan 3*a* and a central point of the second centrifugal fan 3*b* are located on the same straight line running along the width direction of the housing 5.

FIG. 28 illustrates an exemplary case where the first centrifugal fan 3*a* and the second centrifugal fan 3*b* are disposed so that the central point of the first centrifugal fan 3*a* and the central point of the second centrifugal fan 3*b* are located on different straight lines running along the width direction of the housing 5. For example, it is appropriate that the first centrifugal fan 3*a* and the second centrifugal fan 3*b* be disposed so that a central point A of the first centrifugal fan 3*a* is located closer to the rear surface of the housing 5 and a central point B of the second centrifugal fan 3*b* is located closer to the front surface of the housing 5.

When the plurality of centrifugal fans 3 are disposed at the positions illustrated in FIG. 28, the second centrifugal fan 3*b* whose air passage is partially blocked by the compressor 1 and the control box 2 can be disposed away from the compressor 1 and the control box 2, that is, closer to the front surface of the housing 5. By disposing the centrifugal fan 3 away from air passage resistance bodies such as the compressor 1 and the control box 2, an aerodynamic loss, abnormal sound, and noise can be reduced.

Note that FIG. 27 and FIG. 28 each illustrates the exemplary heat source device 1*a*-3 including the compressor 1 but the presence or absence of the compressor 1 and the control box 2, the disposition of the compressor 1 and the control box 2, and the layout of the drain pan 8 are not limited to those in the figures.

Embodiment 4

Embodiment 4 of the present disclosure is described below. In Embodiment 4, the same description as that of Embodiment 1 to Embodiment 3 is omitted and parts identical with or corresponding to those in Embodiment 1 to Embodiment 3 are shown by the same reference signs.

Note that, in Embodiment 4 including its modification example, it is assumed that the air inlet 7 is formed at the rear surface of the housing 5 and the air outlet 10 is formed at the front surface of the housing 5. However, the positions where the air inlet 7 and the air outlet 10 are formed are not particularly limited.

Figure 29:
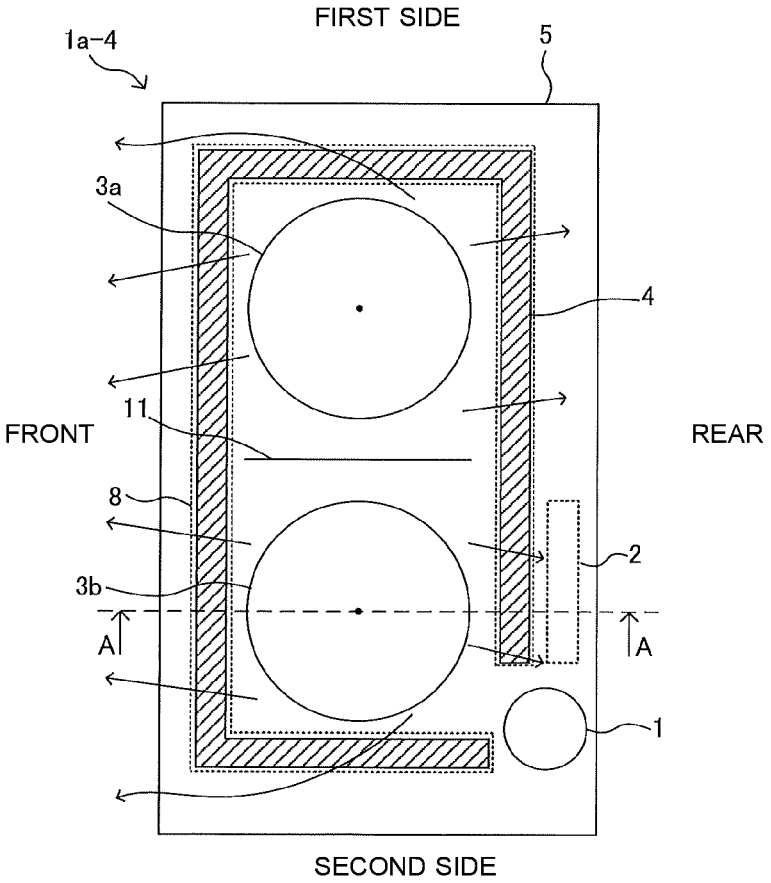
FIG. 29 is a schematic top view schematically illustrating a state in which an example of a heat source device that is one type of a heat exchange unit according to Embodiment 4 of the present disclosure is viewed from the top.
Figure 30:
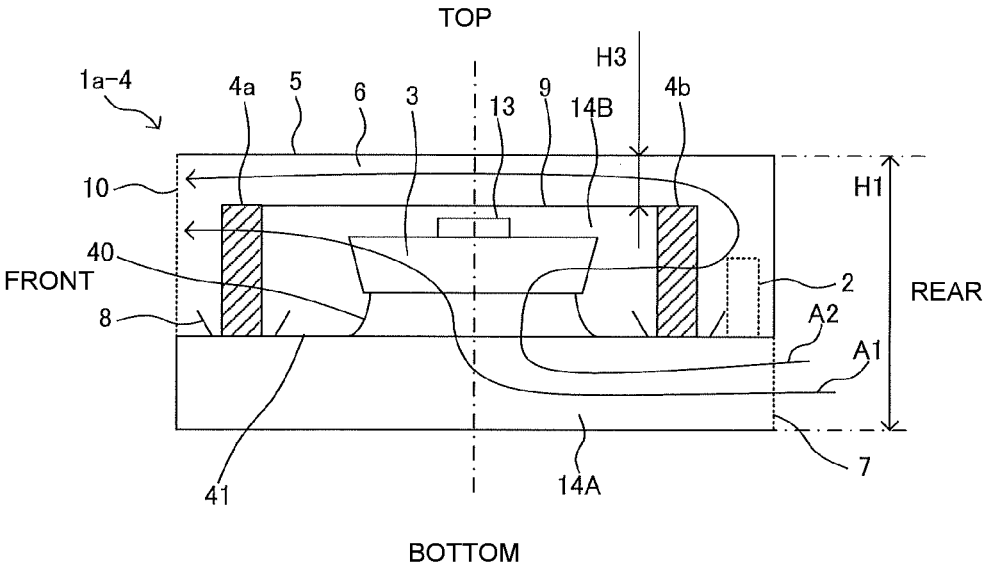
FIG. 30 is a schematic sectional view schematically illustrating an example of a cross section taken along the line A-A in FIG. 29.

FIG. 29 is a schematic top view schematically illustrating a state in which an example of a heat source device 1*a*-4 that is one type of a heat exchange unit according to Embodiment 4 of the present disclosure is viewed from the top. FIG. 30 is a schematic sectional view schematically illustrating an example of a cross section taken along the line A-A in FIG. 29. The heat source device 1*a*-4 is described below with reference to FIG. 29 and FIG. 30. Note that FIG. 29 schematically illustrates the inside of the heat source device 1*a*-4. Further, FIG. 29 illustrates an exemplary state in which the right in the drawing sheet is the rear surface of the heat source device 1*a*-4, the left in the drawing sheet is the front surface of the heat source device 1*a*-4, the top in the drawing sheet is a first side surface of the heat source device 1*a*-4, and the bottom in the drawing sheet is a second side surface of the heat source device 1*a*-4. Further, in FIG. 29, airflows are shown by arrows. Further, in FIG. 30, airflows are shown by the arrow A1 and the arrow A2.

FIG. 29 illustrates an exemplary case where a plurality of centrifugal fans 3 are disposed in the housing 5. However, the number of disposed centrifugal fans 3 need not be plural. FIG. 29 illustrates that one of the plurality of centrifugal fans 3 that is located at the top in the drawing sheet is referred to as the first centrifugal fan 3*a* and the other one of the plurality of centrifugal fans 3 that is located at the bottom in the drawing sheet is referred to as the second centrifugal fan 3*b*. Note that the number of disposed centrifugal fans 3 may be one as in Embodiment 1 or Embodiment 2.

Further, in Embodiment 4, the heat exchangers 4 are disposed around the first centrifugal fan 3*a* and the second centrifugal fan 3*b* at positions where the heat exchangers 4 face the four sides of the housing 5 as illustrated in FIG. 29. Since the fan-to-fan partition plate 11 is disposed, no heat exchanger 4 is disposed below the first centrifugal fan 3*a* in the drawing sheet and above the second centrifugal fan 3*b* in the drawing sheet. Note that FIG. 30 illustrates that, when the heat source device 1*a*-4 is viewed in cross section, the heat exchanger 4 disposed at a position where the heat exchanger 4 faces the front surface of the housing 5 is referred to as a heat exchanger 4*a* and the heat exchanger 4 disposed at a position where the heat exchanger 4 faces the rear surface of the housing 5 is referred to as a heat exchanger 4*b*.

In Embodiment 4, a bypass air passage 6 is provided in the housing 5. Specifically, in the heat source device 1*a*-4, the bypass air passage 6 is formed in the housing 5 by providing a bypass partition plate 9 in the housing 5 as illustrated in FIG. 30. The bypass partition plate 9 runs in parallel to the partition plate 41 at a position over the heat exchangers 4. The bypass air passage 6 guides, directly to the air outlet 10, air blown from the centrifugal fan 3 and passing through a subset of the heat exchangers 4. By providing the bypass air passage 6, a large amount of air can flow into the heat exchanger 4*b*, which is disposed away from the air outlet 10 so that air hardly flows in.

The bypass partition plate 9 corresponds to a "second partition plate".

FIG. 30 illustrates the height of the bypass air passage 6 as a height H3. Specifically, the height H3 is a distance between the bypass partition plate 9 and the top surface of the housing 5. Further, FIG. 30 illustrates the height of the housing 5 as the height H1. Specifically, the height H1 is a distance between the top surface of the housing 5 and the bottom surface of the housing 5.

Figure 31:
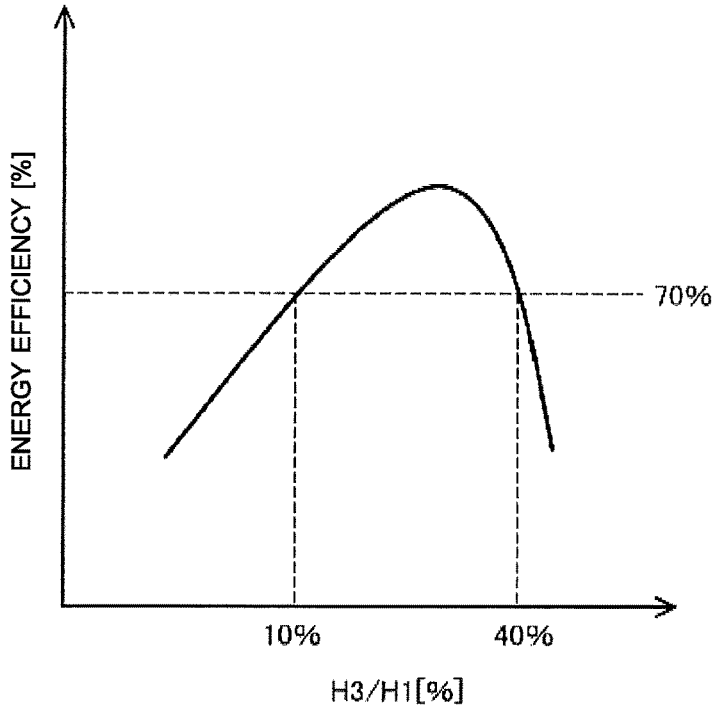
FIG. 31 is a graph illustrating an example of an analysis result when a bypass air passage is provided.

FIG. 31 is a graph illustrating an example of an analysis result when the bypass air passage 6 is provided. FIG. 31 illustrates a relationship between energy efficiency and H3/H1, which is a ratio between the height H3 and the height H1. In FIG. 31, the vertical axis is the energy efficiency (%) and the horizontal axis is H3/H1(%).

FIG. 31 demonstrates that relatively high energy efficiency is attained in a wide range by setting the height H3 within a range in which H3/H1 is 40% or lower. FIG. 31 also demonstrates that the energy efficiency abruptly decreases when H3/H1 is higher than 40%. Further, FIG. 31 demonstrates that a certain value of H3/H1 within the range of 40% or lower is a peak and the energy efficiency decreases thereafter. Therefore, energy efficiency of 70% or higher can be attained by setting H3/H1 preferably within a range of 10% to 40%.

Next, a modification example of the disposition of the heat exchangers 4 is described.

Figure 32:
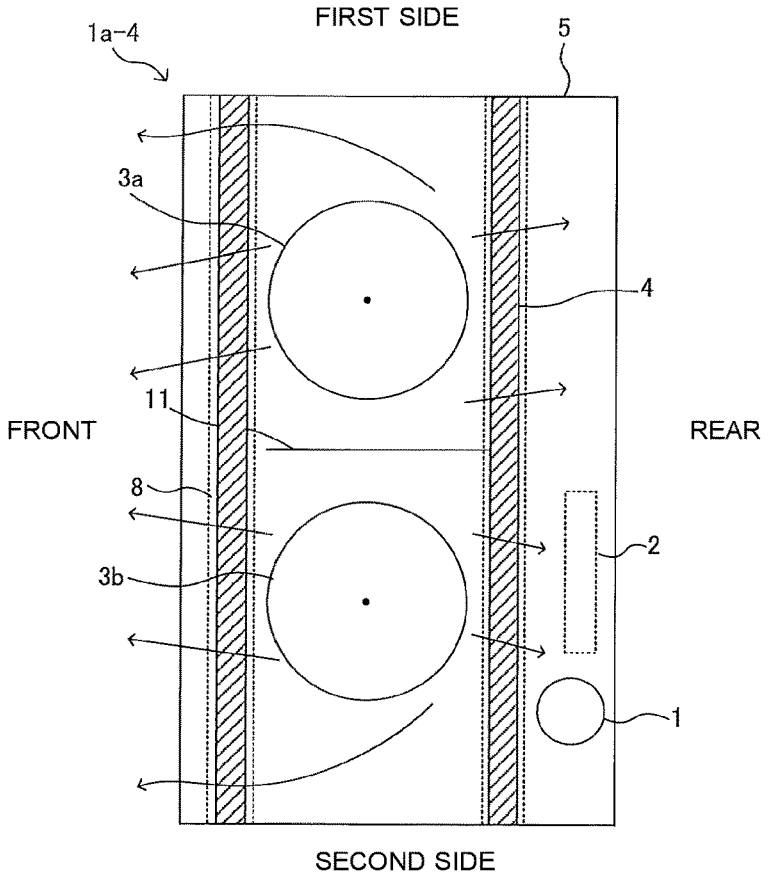
FIG. 32 is a schematic top view schematically illustrating a state in which an example of the heat source device that is one type of the heat exchange unit according to Embodiment 4 of the present disclosure is viewed from the top.

FIG. 32 is a schematic top view schematically illustrating a state in which an example of the heat source device 1*a*-4 is viewed from the top.

FIG. 29 illustrates the exemplary case where the heat exchangers 4 are disposed at positions where the heat exchangers 4 face the four sides of the housing 5. FIG. 32 illustrates an exemplary case where the heat exchangers 4 are disposed at positions where the heat exchangers 4 face two sides of the housing 5. Specifically, the heat exchangers 4 are disposed at positions where the heat exchangers 4 face the front surface and rear surface of the housing 5 depending on the positions where the air inlet 7 and the air outlet 10 are formed. That is, the bypass air passage 6 can exert its effect even in a layout in which the heat exchangers 4 are disposed at two sides as illustrated in FIG. 32 as well as the layout in which the heat exchangers 4 are disposed at the four sides.

Note that the description is made with reference to FIG. 29 to FIG. 32 on the assumption that the heat source device 1*a*-4 includes the compressor 1 but the presence or absence of the compressor 1 and the control box 2, the disposition of the compressor 1 and the control box 2, and the layout of the drain pan 8 are not limited to those shown in the figures.

Embodiment 5

Embodiment 5 of the present disclosure is described below. In Embodiment 5, the same description as that of Embodiment 1 to Embodiment 4 is omitted and parts identical with or corresponding to those in Embodiment 1 to Embodiment 4 are shown by the same reference signs.

Note that, in Embodiment 5, it is assumed that the air inlet 7 is formed at the rear surface of the housing 5 and the air outlet 10 is formed at the front surface of the housing 5. However, the positions where the air inlet 7 and the air outlet 10 are formed are not particularly limited.

Figure 33:
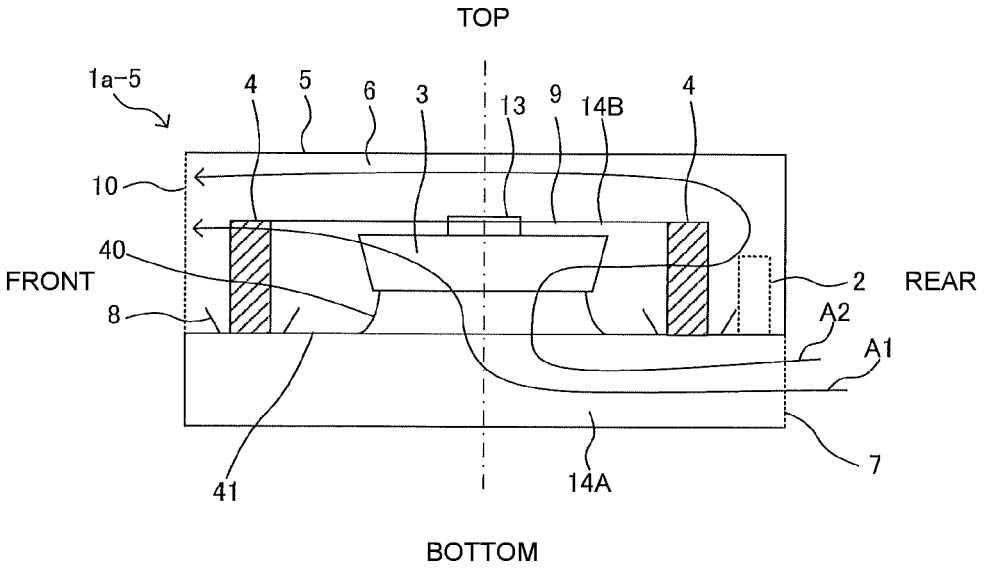
FIG. 33 is a schematic sectional view schematically illustrating an example of a heat source device that is one type of a heat exchange unit according to Embodiment 5 of the present disclosure in association with the cross section taken along the line A-A in FIG. 1.

FIG. 33 is a schematic sectional view schematically illustrating an example of a heat source device 1*a*-5 that is one type of a heat exchange unit according to Embodiment 5 of the present disclosure in association with the cross section taken along the line A-A in Fig. Note that FIG. 33 illustrates an exemplary state in which the right in the drawing sheet is the rear surface of the heat source device Ia-5 and the left in the drawing sheet is the front surface of the heat source device Ia-5. Further, in FIG. 33, airflows are shown by the arrow A1 and the arrow A2.

In Embodiment 5, the bypass air passage 6 is provided in the housing 5 and a part of the fan motor 13 provided on the centrifugal fan 3 protrudes into the bypass air passage 6. As described in Embodiment 4, by providing the bypass air passage 6, air easily flows into the heat exchanger 4 disposed at the rear surface away from the air outlet 10. Thus, sufficient air convection occurs in the bypass air passage 6. Therefore, by causing the part of the fan motor 13 to protrude into the bypass air passage 6, the fan motor 13 can be cooled by using the convection of air flowing through the bypass air passage 6. Accordingly, the quality can be improved.

Further, a cooler and a component to be provided together with the cooler can be reduced by providing the convection cooling function. Thus, the structure can be simplified. When the heat exchangers 4 function as a condenser configured to heat air, on the other hand, air can be heated by waste heat of the fan motor 13. Accordingly, the energy efficiency can be improved.

Note that the description is made with reference to FIG. 33 on the assumption that the heat source device 1*a*-5 includes the compressor 1 but the presence or absence of the compressor 1 and the control box 2, the disposition of the compressor 1 and the control box 2, and the layout of the drain pan 8 are not limited to those in the figures.

Embodiment 6

Embodiment 6 of the present disclosure is described below. In Embodiment 6, the same description as that of Embodiment 1 to Embodiment 5 is omitted and parts identical with or corresponding to those in Embodiment 1 to Embodiment 5 are shown by the same reference signs.

Note that, in Embodiment 6, it is assumed that the air inlet 7 is formed at the rear surface of the housing 5 and the air outlet 10 is formed at the front surface of the housing 5. However, the positions where the air inlet 7 and the air outlet 10 are formed are not particularly limited.

Figure 34:
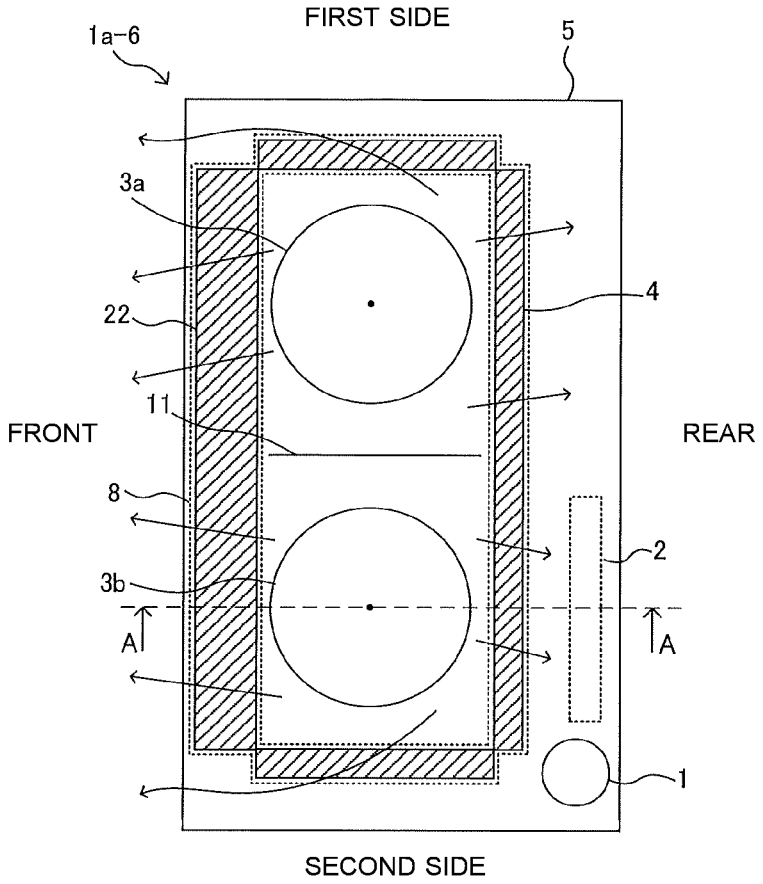
FIG. 34 is a schematic top view schematically illustrating a state in which an example of a heat source device that is one type of a heat exchange unit according to Embodiment 6 of the present disclosure is viewed from the top.
Figure 35:
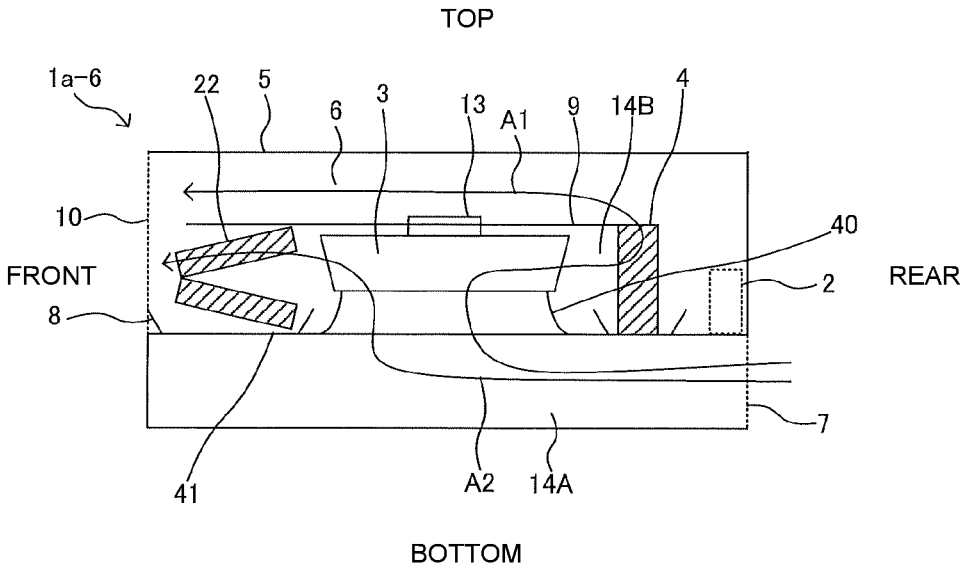
FIG. 35 is a schematic sectional view schematically illustrating an example of a cross section taken along the line A-A in FIG. 34.
Figure 36:
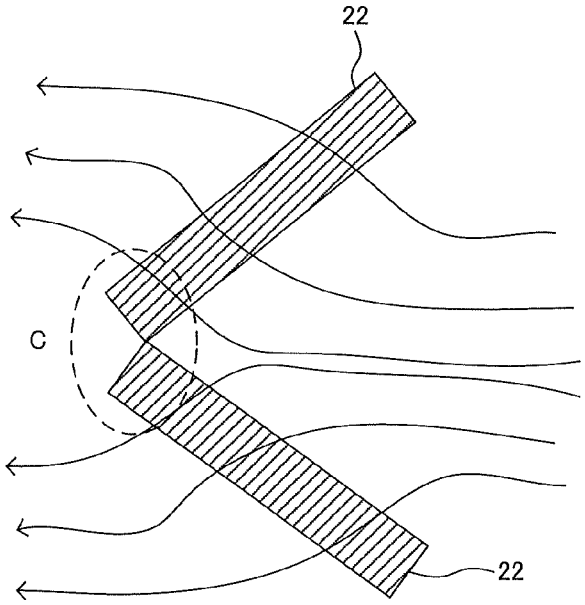
FIG. 36 is a schematic view schematically illustrating a state in which an example of the heat exchanger is viewed from a side in cross section.
Figure 37:
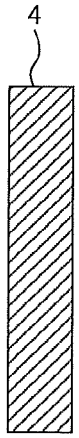
FIG. 37 is a schematic view schematically illustrating a state in which an example of the heat exchanger is viewed from a side in cross section.

FIG. 34 is a schematic top view schematically illustrating a state in which an example of a heat source device 1*a*-6 that is one type of a heat exchange unit according to Embodiment 6 of the present disclosure is viewed from the top. FIG. 35 is a schematic sectional view schematically illustrating an example of a cross section taken along the line A-A in FIG. 34. FIG. 36 and FIG. 37 are schematic views schematically illustrating states in which examples of the heat exchanger 4 are viewed from a side in cross section. The heat source device 1*a*-6 is described below with reference to FIG. 34 to FIG. 37. Note that FIG. 34 schematically illustrates the inside of the heat source device 1*a*-6. Further, FIG. 34 illustrates an exemplary state in which the right in the drawing sheet is the rear surface of the heat source device 1*a*-6, the left in the drawing sheet is the front surface of the heat source device 1*a*-6, the top in the drawing sheet is a first side surface of the heat source device 1*a*-6, and the bottom in the drawing sheet is a second side surface of the heat source device 1*a*-6. Further, in FIG. 34 and FIG. 36, airflows are shown by arrows. Further, in FIG. 35, airflows are shown by the arrow A1 and the arrow A2.

In Embodiment 6, the heat exchangers 4 are disposed around the first centrifugal fan 3*a* and the second centrifugal fan 3*b* at positions where the heat exchangers 4 face the four sides of the housing 5 as illustrated in FIG. 34. Since the fan-to-fan partition plate 11 is disposed, no heat exchanger 4 is disposed below the first centrifugal fan 3*a* in the drawing sheet and above the second centrifugal fan 3*b* in the drawing sheet.

Further, in Embodiment 6, the heat exchanger 4 disposed on at least one side, in this case at the front surface, has a horizontally tilted V-shape in cross section among the heat exchangers 4 disposed on at least two sides. The heat exchangers 4 facing the remaining three sides, that is, the rear surface, the first side surface, and the second side surface, has a linear shape in cross section.

Note that, in FIG. 34 and FIG. 35, the heat exchanger 4 disposed at the front surface of the housing 5 has the horizontally tilted V-shape in cross section. Further, FIG. 34 and FIG. 35 each illustrates that the heat exchanger 4 disposed in the horizontally tilted V-shape in cross section is distinguished as a heat exchanger 22.

That is, the heat exchanger 22 and the heat exchangers 4 are disposed around the centrifugal fan 3 in the housing 5. By disposing the heat exchanger 22 having the horizontally tilted V-shape in cross section on a part of the sides of the housing 5, the heat exchangers 4 can be mounted with high density. That is, even if the housing 5 is thin, the heat exchangers 4 can be mounted with high density and therefore the heat exchange efficiency can be improved. Further, the energy efficiency can be improved.

Note that, also in Embodiment 6, the bypass air passage 6 is provided in the housing 5. FIG. 34 illustrates an exemplary case where a plurality of centrifugal fans 3 are disposed in the housing 5. However, the number of disposed centrifugal fans 3 need not be plural. FIG. 34 illustrates that one of the plurality of centrifugal fans 3 that is located at the top in the drawing sheet is referred to as the first centrifugal fan 3*a* and the other one of the plurality of centrifugal fans 3 that is located at the bottom in the drawing sheet is referred to as the second centrifugal fan 3*b*. The number of disposed centrifugal fans 3 may be one as in Embodiment 1 or Embodiment 2. Further, in the heat source device 1*a*-6, the bypass air passage 6 is formed in the housing 5 by providing the bypass partition plate 9 in the housing 5 as illustrated in FIG. 35.

Airflows in the heat exchanger 22 are described.

As illustrated in FIG. 36, air hardly flows in a region C near a juncture between an upper heat exchanger in the drawing sheet and a lower heat exchanger in the drawing sheet in the heat exchanger 22. Therefore, the airflow resistance is generally larger than that of the linear heat exchanger 4 illustrated in FIG. 37. In view of this, the heat exchanger 22 having the V-shape in side view is disposed as the heat exchanger 4 near the air outlet 10. Thus, a large amount of air can flow into the heat exchangers 4 located away from the air outlet 10.

Further, when the bypass air passage 6 is provided, the heat exchanger 22 having the V-shape in side view is disposed near the air outlet 10. Thus, the height of the bypass air passage 6 can be reduced.

Figure 38:
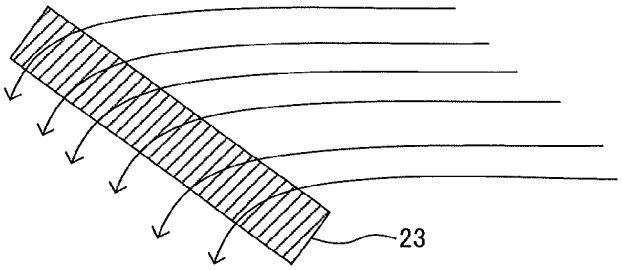
FIG. 38 is a schematic view schematically illustrating a state in which another example of disposition of the heat exchanger is viewed in cross section.

A modification example of the disposition of the heat exchanger 4 is described. FIG. 38 is a schematic view schematically illustrating a state in which another example of the disposition of the heat exchanger 4 is viewed in cross section. Note that, in FIG. 38, airflows are shown by arrows. Further, FIG. 38 illustrates that the heat exchanger 4 inclined in cross section is distinguished as a heat exchanger 23.

As illustrated in FIG. 38, one heat exchanger 4 may be inclined. For example, the heat exchanger 23 is inclined downward from left to right in the drawing sheet as illustrated in FIG. 38. The inclination of the heat exchanger 4 means that the heat exchanger 4 is disposed with its air passing surface running in a direction oblique to the partition plate 41. Note that the heat exchanger 4 may be inclined upward from left to right in the drawing sheet.

By inclining the heat exchanger 23 as illustrated in FIG. 38, the heat exchanger can be mounted with high density under a strict height restriction in the housing 5. Therefore, the heat exchange efficiency can be improved through the disposition of FIG. 38.

As illustrated in FIG. 38, airflows are curved obliquely in the heat exchanger 23. Therefore, the airflow resistance is larger than that of the heat exchanger 4 having a linear shape in cross section. In view of this, the heat exchanger 23 is disposed near the air outlet 10 and the heat exchanger 4 having the linear shape in cross section is disposed away from the air outlet 10. Thus, distribution of airflow rates of air flowing through the respective heat exchangers can be improved.

Note that, as illustrated in FIG. 36 and FIG. 38, the inclination angle and the inclination direction of the heat exchanger 4 may be selected depending on the height position of the centrifugal fan 3 so that the distance between the blade tip of the centrifugal fan 3 and the heat exchanger 4 can be secured.

Further, the description is made with reference to FIG. 34 to FIG. 38 on the assumption that the heat source device 1*a*-6 includes the compressor 1 but the presence or absence of the compressor 1 and the control box 2, the disposition of the compressor 1 and the control box 2, and the layout of the drain pan 8 are not limited to those in the figures.

Embodiment 7

Embodiment 7 of the present disclosure is described below. In Embodiment 7, the same description as that of Embodiment 1 to Embodiment 6 is omitted and parts identical with or corresponding to those in Embodiment 1 to Embodiment 6 are shown by the same reference signs.

Note that, in Embodiment 7, it is assumed that the air inlet 7 is formed at the rear surface of the housing 5 and the air outlet 10 is formed at the front surface of the housing 5. However, the positions where the air inlet 7 and the air outlet 10 are formed are not particularly limited.

Figure 39:
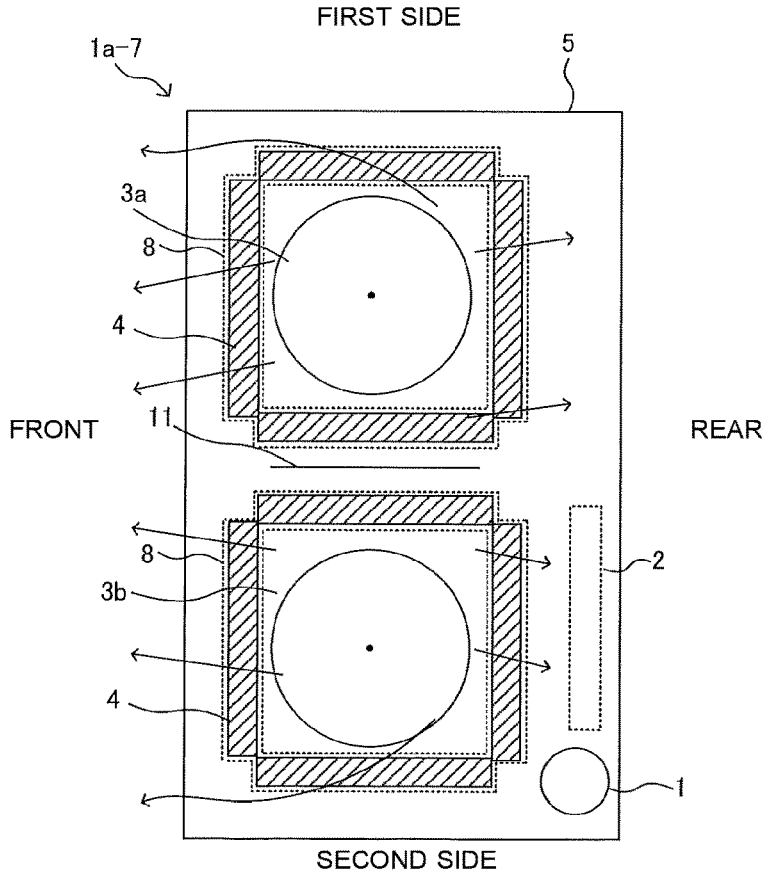
FIG. 39 is a schematic top view schematically illustrating a state in which an example of a heat source device that is one type of a heat exchange unit according to Embodiment 7 of the present disclosure is viewed from the top.

FIG. 39 is a schematic top view schematically illustrating a state in which an example of a heat source device 1*a*-7 that is one type of a heat exchange unit according to Embodiment 7 of the present disclosure is viewed from the top. Note that FIG. 39 illustrates an exemplary state in which the right in the drawing sheet is the rear surface of the heat source device 1*a*-7, the left in the drawing sheet is the front surface of the heat source device 1*a*-7, the top in the drawing sheet is a first side surface of the heat source device 1*a*-7, and the bottom in the drawing sheet is a second side surface of the heat source device 1*a*-7. Further, in FIG. 39, airflows are shown by arrows.

In Embodiment 7, a plurality of centrifugal fans 3 are used and heat exchangers 4 are disposed around each centrifugal fan 3. For example, when two centrifugal fans 3 are used, the heat exchangers 4 are disposed in a shape of eye glasses in top view.

By disposing the heat exchangers 4 around each centrifugal fan 3, the heat exchangers 4 can be mounted with high density. That is, even if the housing 5 is thin, the heat exchangers 4 can be mounted with high density and therefore the heat exchange efficiency can be improved. Further, the energy efficiency can be improved.

Note that description is herein made of an example in which the heat exchangers 4 are disposed around each centrifugal fan 3 in an O-shape in top view but the shape in top view is not limited thereto. Any shape in top view may be employed if the heat exchangers 4 are disposed around each centrifugal fan 3. For example, when the plurality of centrifugal fans 3 are disposed, it is appropriate that the control box 2 be disposed so that its center is located at the center between the centrifugal fans 3. Thus, the ratio between the airflow rates in the respective centrifugal fans 3 that vary due to closure of air passages by the control box 2 can be more balanced among the centrifugal fans 3.

Further, the description is made with reference to FIG. 39 on the assumption that the heat source device 1*a*-7 includes the compressor 1 but the presence or absence of the compressor 1 and the control box 2, the disposition of the compressor 1 and the control box 2, and the layout of the drain pan 8 are not limited to those in the figures.

Embodiment 8

Embodiment 8 of the present disclosure is described below. In Embodiment 8, the same description as that of Embodiment 1 to Embodiment 7 is omitted and parts identical with or corresponding to those in Embodiment 1 to Embodiment 7 are shown by the same reference signs.

Note that, in Embodiment 8 including its modification examples, it is assumed that the air inlet 7 is formed at the rear surface of the housing 5 and the air outlet 10 is formed at the front surface of the housing 5. However, the positions where the air inlet 7 and the air outlet 10 are formed are not particularly limited.

Figure 40:
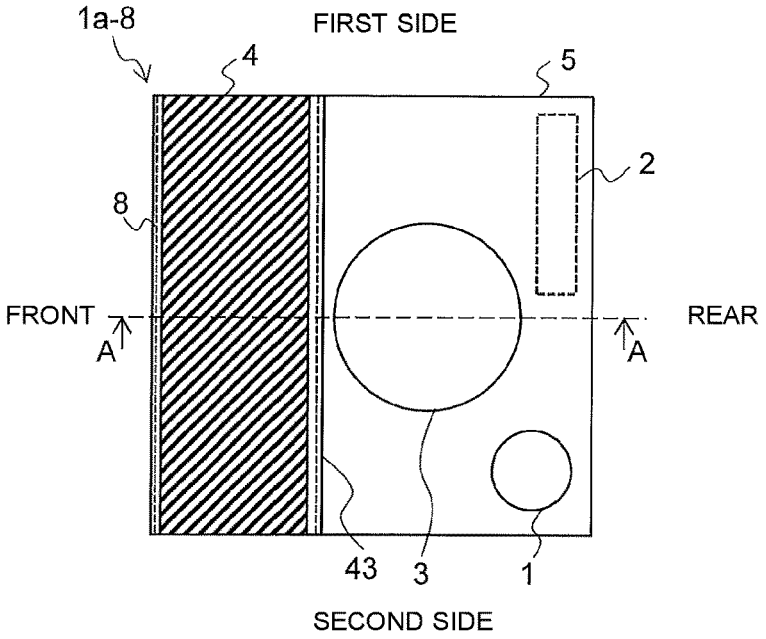
FIG. 40 is a schematic top view schematically illustrating a state in which an example of a heat source device that is one type of a heat exchange unit according to Embodiment 8 of the present disclosure is viewed from the top.
Figure 41:
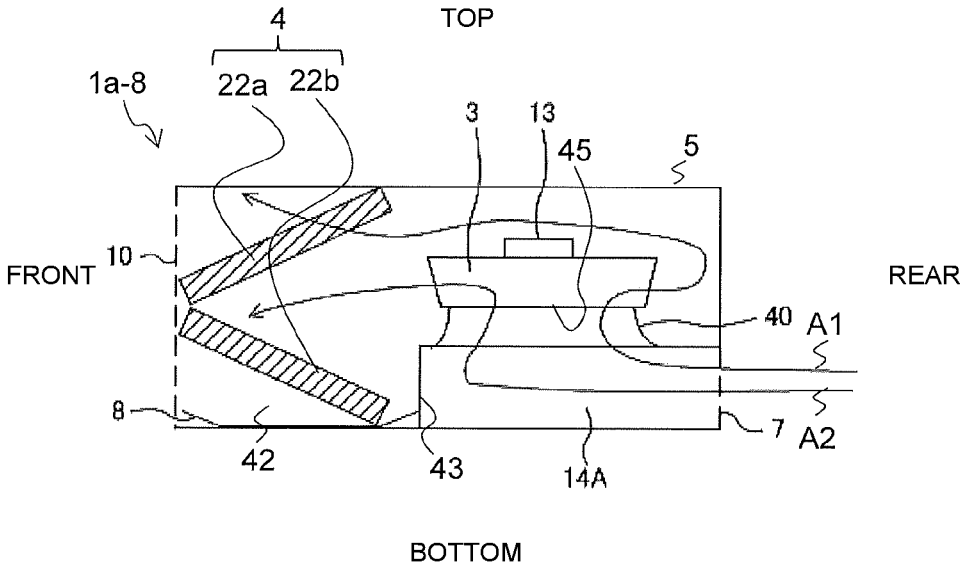
FIG. 41 is a schematic sectional view schematically illustrating an example of a cross section taken along the line A-A in FIG. 40.

FIG. 40 is a schematic top view schematically illustrating a state in which an example of a heat source device that is one type of a heat exchange unit according to Embodiment 8 of the present disclosure is viewed from the top. FIG. 41 is a schematic sectional view schematically illustrating an example of a cross section taken along the line A-A in FIG. 40. A heat source device 1*a*-8 is described below with reference to FIG. 40 and FIG. 41. Note that FIG. 40 schematically illustrates the inside of the heat source device 1*a*-8. Further, FIG. 40 illustrates an exemplary state in which the right in the drawing sheet is the rear surface of the heat source device 1*a*-8, the left in the drawing sheet is the front surface of the heat source device 1*a*-8, the top in the drawing sheet is a first side surface of the heat source device 1*a*-8, and the bottom in the drawing sheet is a second side surface of the heat source device 1*a*-8. Further, in FIG. 41, airflows are shown by the arrow A1 and the arrow A2.

As illustrated in FIG. 41, the inflow air passage 14A is provided in a space below the fan inlet 45 of the centrifugal fan 3 to reach the rear surface. As illustrated in FIG. 40 and FIG. 41, an outflow air passage 42 is provided on a downstream side of the centrifugal fan 3. The outflow air passage 42 and the inflow air passage 14A are partitioned from each other by an inlet/outlet partition plate 43. With this structure, a wide space can be secured between the centrifugal fan 3 and the rear surface of the housing 5. Therefore, air blown to the rear surface side of the centrifugal fan 3 (away from the air outlet 10) can efficiently pass through the heat exchanger 4. As a result, the heat exchange efficiency is improved.

Figure 42:
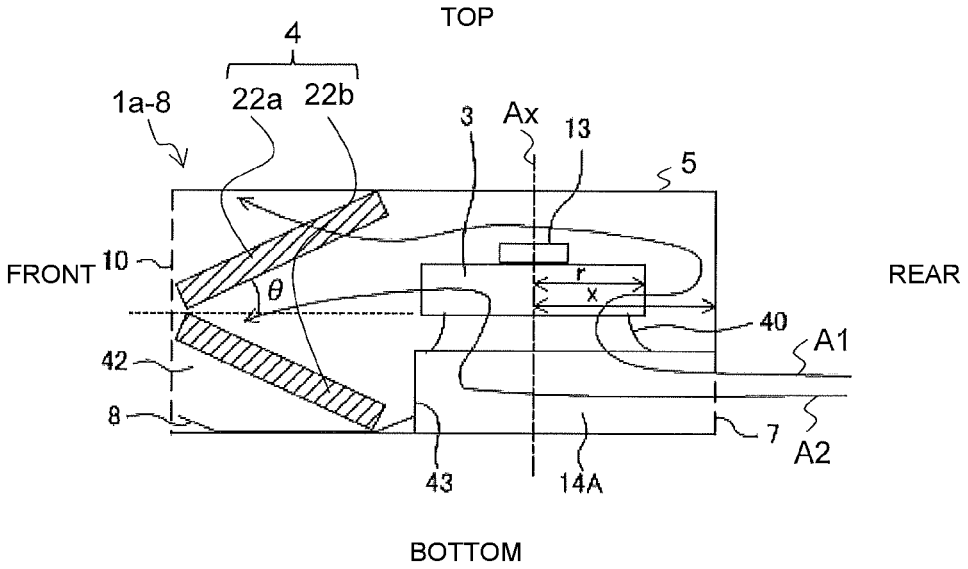
FIG. 42 is a diagram describing a relationship between an airflow resistance and the position of a centrifugal fan in the heat exchange unit according to Embodiment 8 of the present disclosure.
Figure 43:
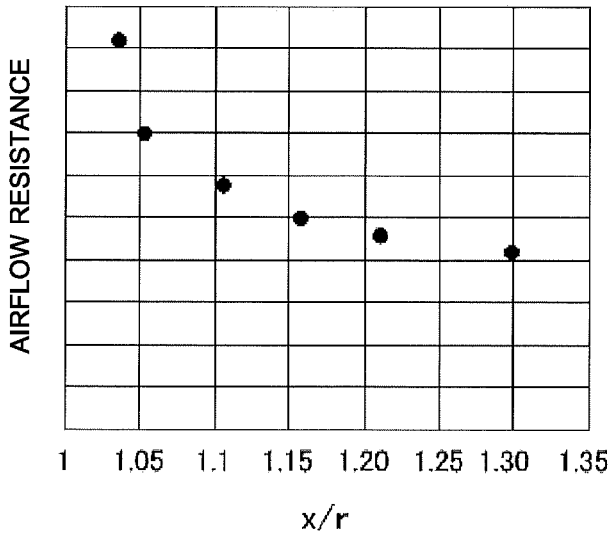
FIG. 43 is a graph illustrating an example of a relationship between the airflow resistance and a ratio between a fan radius and a distance from a rotational center axis of the centrifugal fan to a rear surface in the heat exchange unit according to Embodiment 8 of the present disclosure.

Particularly when the centrifugal fan 3 is mounted in the housing with high density and when the outer periphery of the centrifugal fan 3 is excessively close to the rear surface of the housing 5, the airflow resistance increases abruptly. FIG. 42 is a diagram describing a relationship between the airflow resistance and the position of the centrifugal fan in the heat exchange unit according to Embodiment 8 of the present disclosure. As illustrated in FIG. 42, the fan radius of the centrifugal fan 3 is defined as r and a distance from a rotational center axis Ax of the centrifugal fan 3 to the rear surface of the housing 5 is defined as x. FIG. 43 is a graph illustrating an example of a result of an experiment conducted by the inventors. FIG. 43 is a graph illustrating an example of a relationship between the airflow resistance and a ratio between the fan radius and the distance from the rotational center axis of the centrifugal fan to the rear surface in the heat exchange unit according to Embodiment 8 of the present disclosure. The horizontal axis of FIG. 43 is a value of the ratio (x/r) and the vertical axis of FIG. 43 is the airflow resistance. Referring to the result of the experiment illustrated in FIG. 43, the airflow resistance increases abruptly within a range in which the value of the ratio (x/r) is 1.05 or lower. Therefore, the distance x is desirably a value at which the value of the ratio (x/r) is higher than 1.05. Further, the value of the ratio (x/r) is desirably 1.10 or higher.

Further, the inflow air passage 14A does not reach the front surface of the housing 5 as illustrated in FIG. 40 and FIG. 41. Thus, the front surface area of the heat exchanger 4 disposed on the periphery of the outflow air passage 42 can be increased. Therefore, air blown to the rear surface side of the centrifugal fan 3 (away from the air outlet 10) can efficiently pass through the heat exchanger 4. As a result, the heat exchange efficiency is improved.

Further, the heat source device 1*a*-8 of Embodiment 8 includes a heat exchanger 4 having a horizontally tilted V-shape in cross section. The heat exchanger 4 includes an upper heat exchanger 22*a* and a lower heat exchanger 22*b*. As illustrated in FIG. 42, the heat exchanger 22*a* is inclined by an angle θ from a horizontal direction along the outflow air passage 42. FIG. 42 illustrates that the heat exchanger 22*a* is inclined by the angle θ from an air blowing direction. The heat exchanger 22*b* may also be inclined by the angle θ from the air blowing direction. The inclination angle θ of the heat exchanger 22*a* is an angle of elevation relative to the horizontal direction and the inclination angle θ of the heat exchanger 22*b* is an angle of depression relative to the horizontal direction. By inclining at least one of the heat exchangers 22*a* and 22*b*, the front surface area of the heat exchanger 4 can be increased. Therefore, air blown to the rear surface side of the centrifugal fan 3 (away from the air outlet 10) can efficiently pass through the heat exchanger 4. As a result, the heat exchange efficiency is improved.

Figure 44:
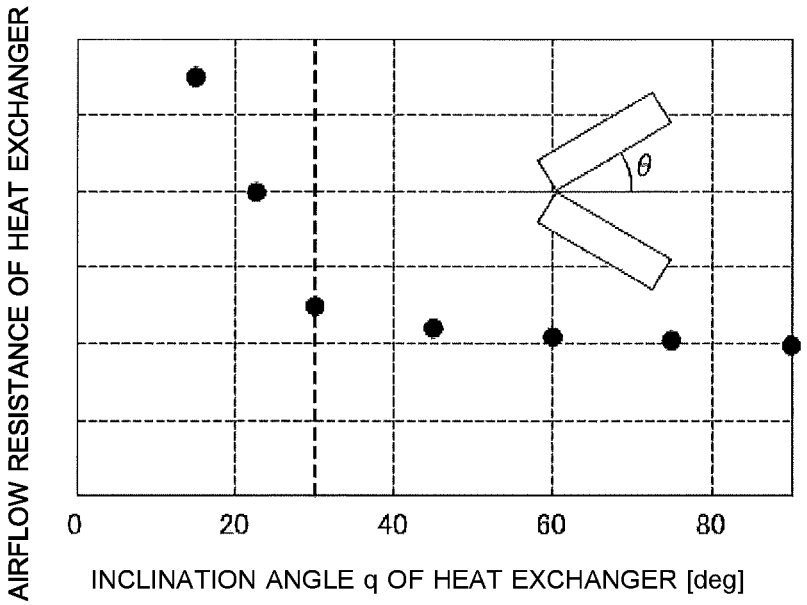
FIG. 44 is a graph illustrating an example of a relationship between the airflow resistance and an inclination angle of a heat exchanger in the heat exchange unit according to Embodiment 8 of the present disclosure.

FIG. 44 illustrates an example of a result of an experiment conducted by the inventors. FIG. 44 is a graph illustrating an example of a relationship between the airflow resistance and the inclination angle of the heat exchanger in the heat exchange unit according to Embodiment 8 of the present disclosure. In this experiment as well, the housing 5 having a height of 500 mm or smaller is used. The result of the experiment in FIG. 44 shows that the airflow resistance of the heat exchanger 4 is reduced by disposing the heat exchangers 22*a* and 22*b* so that their inclination angles θ are 30 degrees or more when the height of the housing 5 is 500 mm or smaller. Therefore, the airflow efficiency is improved.

Figure 45:
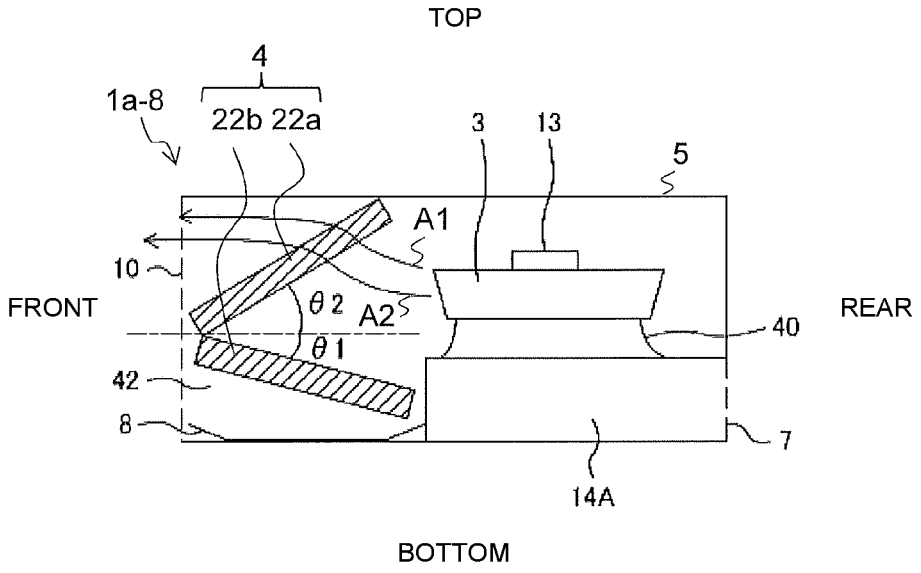
FIG. 45 is a diagram schematically illustrating another example of the heat exchanger according to Embodiment 8 of the present disclosure in association with the cross section taken along the line A-A in FIG. 40.

FIG. 45 is a diagram schematically illustrating another example of the heat exchanger according to Embodiment 8 of the present disclosure in association with the cross section taken along the line A-A in FIG. 40. The heat exchanger 4 illustrated in FIG. 45 has a structure in which an inclination angle θ2 of the upper heat exchanger 22*a* and an inclination angle θ1 of the lower heat exchanger 22*b* differ from each other relative to the horizontal direction along the outflow air passage 42. With the layout of the heat exchanger 4 in which the inclination angle θ2 and the inclination angle θ1 differ from each other, the airflow resistance of the heat exchanger 4 can be controlled. Therefore, the airflow efficiency of the heat exchanger 4 can be controlled. Further, the end of the heat exchanger 4 can be kept away from the centrifugal fan 3 in a relationship of inclination angle $\theta_2$>inclination angle $\theta_1$. Therefore, air blown rearward from the centrifugal fan 3 easily passes through the heat exchanger 4. As a result, the airflow efficiency of the heat exchanger 4 is further improved.

Figure 46:
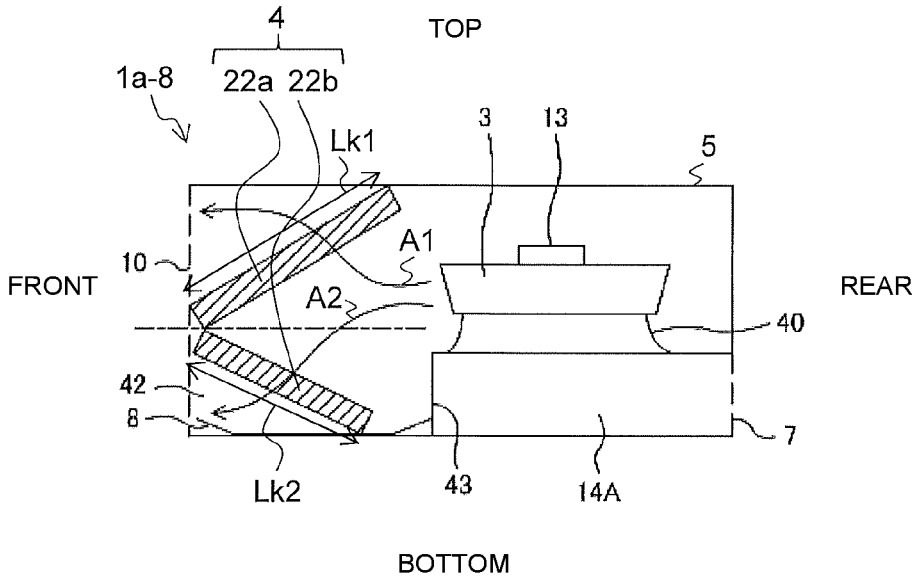
FIG. 46 is a diagram schematically illustrating another example of the heat exchanger according to Embodiment 8 of the present disclosure in association with the cross section taken along the line A-A in FIG. 40.

FIG. 46 is a diagram schematically illustrating another example of the heat exchanger according to Embodiment 8 of the present disclosure in association with the cross section taken along the line A-A in FIG. 40. The structural example illustrated in FIG. 46 has a feature in that a length Lk1 of the upper heat exchanger 22*a* is larger than a length Lk2 of the lower heat exchanger 22*b* in the heat exchanger 4 having the horizontally tilted V-shape in cross section. With this structure, the front surface area of the heat exchanger 4 can be increased by effectively using a space above the centrifugal fan 3 as a space where the heat exchanger 22*a* is disposed. Therefore, the heat exchange efficiency is improved.

Embodiment 9

Embodiment 9 of the present disclosure is described below. In Embodiment 9, the same description as that of Embodiment 1 to Embodiment 8 is omitted and parts identical with or corresponding to those in Embodiment 1 to Embodiment 8 are shown by the same reference signs.

Note that, in Embodiment 9, it is assumed that the air inlet 7 is formed at the rear surface of the housing 5 and the air outlet 10 is formed at the front surface of the housing 5. However, the positions where the air inlet 7 and the air outlet 10 are formed are not particularly limited.

Figure 47:
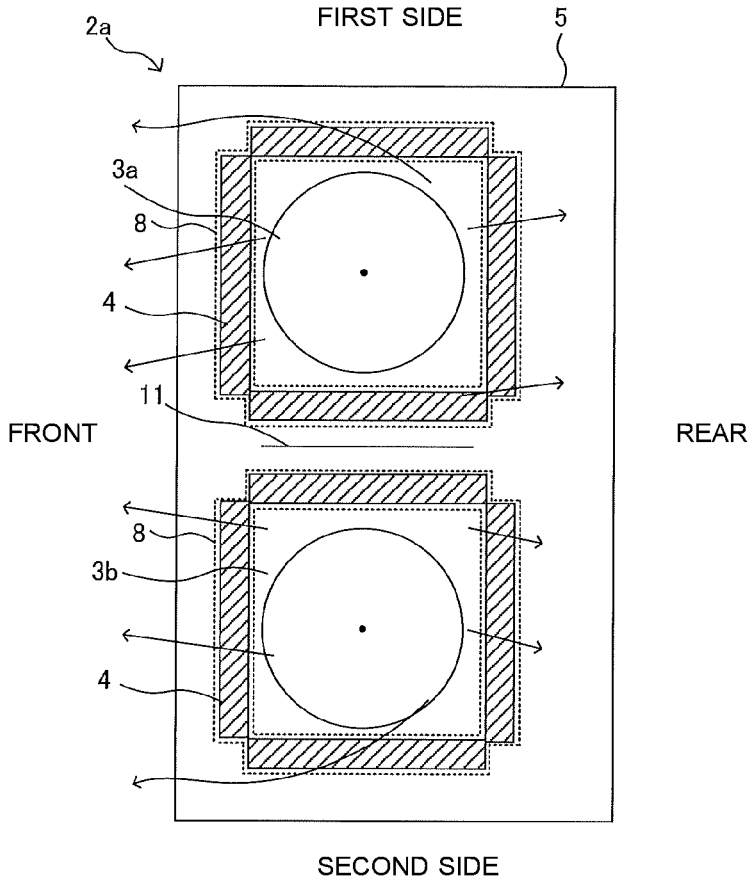
FIG. 47 is a schematic top view schematically illustrating a state in which an example of a load-side device that is one type of a heat exchange unit according to Embodiment 9 of the present disclosure is viewed from the top.

FIG. 47 is a schematic top view schematically illustrating a state in which an example of a load-side device 2*a* that is one type of a heat exchange unit according to Embodiment 9 of the present disclosure is viewed from the top. Note that FIG. 47 illustrates an exemplary state in which the right in the drawing sheet is the rear surface of the load-side device 2*a*, the left in the drawing sheet is the front surface of the load-side device 2*a*, the top in the drawing sheet is a first side surface of the load-side device 2*a*, and the bottom in the drawing sheet is a second side surface of the load-side device 2*a*. Further, in FIG. 47, airflows are shown by arrows. Further, FIG. 47 illustrates an exemplary load-side device 2*a* to which the housing layout of the heat source device 1*a*-7 according to Embodiment 7 is applied.

The load-side device 2*a* is one type of the heat exchange unit being provided with the heat exchanger and is included in an air-conditioning apparatus together with the heat source device according to any one of Embodiment 1 to Embodiment 8.

Further, the housing layout of the heat source device according to any one of Embodiment 1 to Embodiment 8 is applied to the load-side device 2*a*. In general, the load-side device 2*a* may have no compressor 1 or control box 2. That is, the structure of the load-side device 2*a* is similar to a structure in which the compressor 1 and the control box 2 are omitted from the heat source device according to any one of Embodiment 1 to Embodiment 8.

That is, there is no need to concern the blockage of air passages by the compressor 1 and the control box 2 in the load-side device 2*a*. Thus, the heat exchangers 4 can be mounted with high density.

Note that FIG. 47 illustrates the exemplary structure in which the housing layout of the heat source device 1*a*-7 according to Embodiment 7 is applied but the housing layout of the heat source device according to any one of Embodiment 1 to Embodiment 8 may be applied to the load-side device 2*a*.

Embodiment 10

Embodiment 10 of the present disclosure is described below. In Embodiment 10, the same description as that of Embodiment 1 to Embodiment 9 is omitted and parts identical with or corresponding to those in Embodiment 1 to Embodiment 9 are shown by the same reference signs. Note that a refrigerant circuit structure illustrated in FIG. 48 and FIG. 49 only shows a general vapor compression-type refrigeration cycle and the refrigerant circuit structure of an air-conditioning apparatus 100 is not limited thereto. Further, distinction is made such that the heat exchanger 4 of the load-side device 2*a* is a first heat exchanger 4-1 and the heat exchanger 4 of the heat source device 1*a*-1 is a second heat exchanger 4-2.

Figure 48:
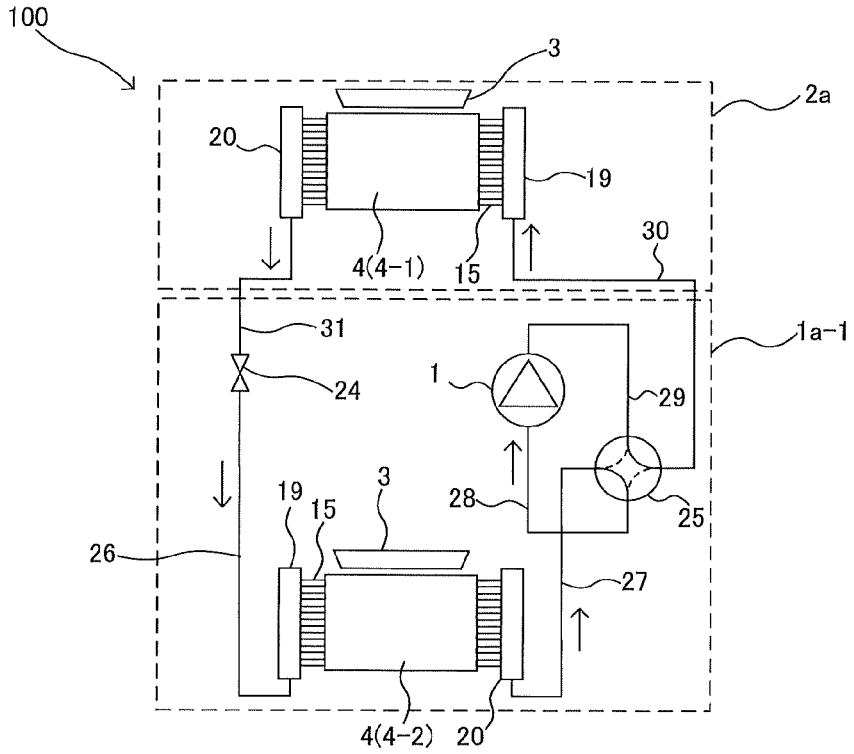
FIG. 48 is a structural view schematically illustrating an example of a refrigerant circuit structure of an air-conditioning apparatus according to Embodiment 10 of the present disclosure.
Figure 49:
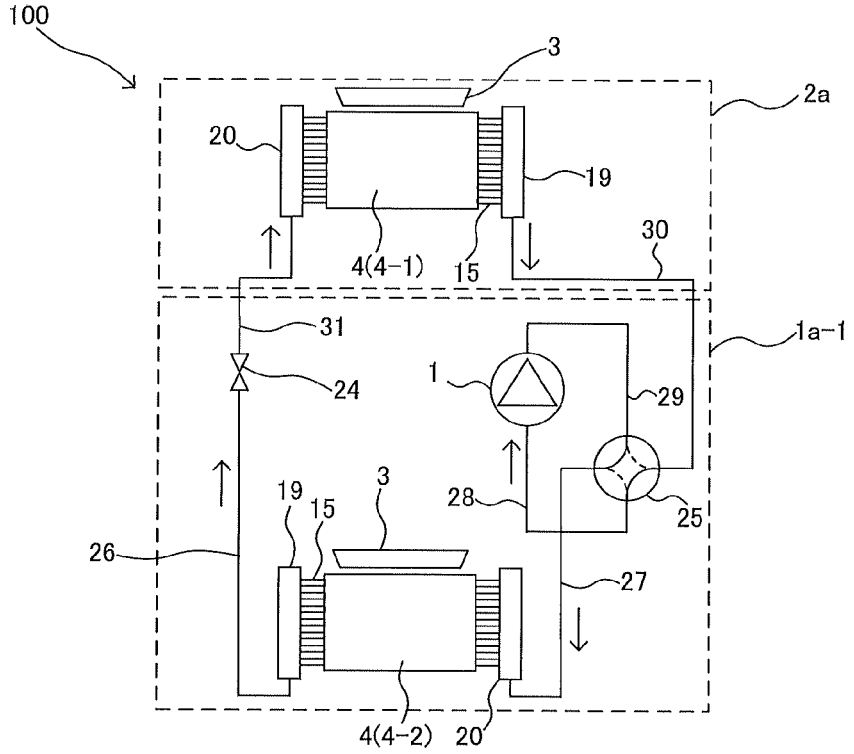
FIG. 49 is a structural view schematically illustrating the example of the refrigerant circuit structure of the air-conditioning apparatus according to Embodiment 10 of the present disclosure.

FIG. 48 and FIG. 49 are structural views schematically illustrating an example of the refrigerant circuit structure of the air-conditioning apparatus 100 according to Embodiment 10 of the present disclosure. The air-conditioning apparatus 100 is described with reference to FIG. 48 and FIG. 49. The air-conditioning apparatus 100 includes at least one of the heat source device according to any one of Embodiment 1 to Embodiment 7 and the load-side device 2*a* according to Embodiment 9. Note that FIG. 48 illustrates an exemplary case where the air-conditioning apparatus 100 includes both the heat source device 1*a*-1 according to Embodiment 1 and the load-side device 2*a* according to Embodiment 9 but the air-conditioning apparatus 100 is not limited thereto. The air-conditioning apparatus 100 may include at least one of the heat source device according to any one of Embodiment 1 to Embodiment 7 and the load-side device 2*a* according to Embodiment 9.

FIG. 48 and FIG. 49 each illustrates an exemplary air-conditioning apparatus 100 capable of switching flows of refrigerant. In FIG. 48, arrows represent a flow of refrigerant when the first heat exchanger 4-1 functions as a condenser and the second heat exchanger 4-2 functions as an evaporator, that is, during a heating operation. In FIG. 49, on the other hand, arrows represent a flow of refrigerant when the first heat exchanger 4-1 functions as an evaporator and the second heat exchanger 4-2 functions as a condenser, that is, during a cooling operation.

The air-conditioning apparatus 100 includes the compressor 1, a flow switching device 25, the first heat exchanger 4-1, a pressure reducing device 24, and the second heat exchanger 4-2 as main devices. The air-conditioning apparatus 100 includes a first connection pipe 29, a second connection pipe 30, a third connection pipe 31, a fourth connection pipe 26, a fifth connection pipe 27, and a sixth connection pipe 28 as refrigerant pipes connecting the main devices. That is, the air-conditioning apparatus 100 has a refrigerant circuit in which the compressor 1, the flow switching device 25, the first heat exchanger 4-1, the pressure reducing device 24, and the second heat exchanger 4-2 are connected by the refrigerant pipes.

The first connection pipe 29 is a refrigerant pipe connecting the compressor 1 and the flow switching device 25. The second connection pipe 30 is a refrigerant pipe connecting the flow switching device 25 and the first heat exchanger 4-1. The third connection pipe 31 is a refrigerant pipe connecting the first heat exchanger 4-1 and the pressure reducing device 24. The fourth connection pipe 26 is a refrigerant pipe connecting the pressure reducing device 24 and the second heat exchanger 4-2. The fifth connection pipe 27 is a refrigerant pipe connecting the second heat exchanger 4-2 and the flow switching device 25. The sixth connection pipe 28 is a refrigerant pipe connecting the flow switching device 25 and the compressor 1.

The illustration is herein made of the exemplary case where the flow switching device 25 is provided and is capable of switching flows of refrigerant but the flow of refrigerant may be fixed without the flow switching device 25. In this case, the first heat exchanger 4-1 functions only as a condenser and the second heat exchanger 4-2 functions only as an evaporator.

The heat source device 1*a*-1 is installed in a space other than an air-conditioned space, for example, installed outdoors, and has a function of supplying cooling energy or heating energy to the load-side device 2*a*.

The load-side device 2*a* is installed in a space where the cooling energy or the heating energy is supplied to the air-conditioned space, for example, installed indoors, and cools or heats the air-conditioned space by using the cooling energy or the heating energy supplied from the heat source device 1*a*-1. The description is herein made of the exemplary case where the pressure reducing device 24 is provided in the heat source device 1*a*-1 but the pressure reducing device 24 may be provided in the load-side device 2*a*.

The compressor 1 compresses and discharges refrigerant. Examples of the compressor 1 may include a rotary compressor, a scroll compressor, a screw compressor, and a reciprocating compressor. When the first heat exchanger 4-1 functions as a condenser, the refrigerant discharged from the compressor 1 is sent to the first heat exchanger 4-1. When the first heat exchanger 4-1 functions as an evaporator, the refrigerant discharged from the compressor 1 is sent to the second heat exchanger 4-2.

The flow switching device 25 is provided on a discharge side of the compressor 1 and switches flows of refrigerant between the heating operation and the cooling operation. Examples of the flow switching device 25 may include a four-way valve, a combination of three-way valves, and a combination of two-way valves.

The first heat exchanger 4-1 functions as a condenser or an evaporator. Examples thereof may include a fin-and-tube heat exchanger.

The pressure reducing device 24 reduces a pressure of refrigerant passing through the first heat exchanger 4-1 or the second heat exchanger 4-2. Examples of the pressure reducing device 24 may include an electronic expansion valve. Examples of the pressure reducing device 24 may also include a flow resistor obtained by combining a capillary tube and a valve, or the like.

The second heat exchanger 4-2 functions as an evaporator or a condenser. Examples thereof may include a fin-and-tube heat exchanger.

Referring to FIG. 48, an action during the heating operation of the air-conditioning apparatus 100 is described together with the flow of refrigerant.

In the compressor 1, the refrigerant turns into high-temperature and high-pressure refrigerant superheated vapor and flows into the load-side device 2*a* through the first connection pipe 29 and the second connection pipe 30. The refrigerant flowing into the load-side device 2*a* flows into the first heat exchanger 4-1 via the refrigerant distribution pipe 19 and is cooled by exchanging heat with air supplied by the centrifugal fan 3 in the first heat exchanger 4-1. At this time, indoor air passing through the first heat exchanger 4-1 is heated by the refrigerant and is sent to the air-conditioned space such as a living space. Therefore, the air-conditioned space is heated and thus the heating operation is achieved.

The refrigerant cooled by the first heat exchanger 4-1 flows out of the first heat exchanger 4-1 via the refrigerant collection pipe 20 in a state of subcooled liquid or two-phase gas-liquid refrigerant. The refrigerant flowing out of the first heat exchanger 4-1 flows into the pressure reducing device 24 through the third connection pipe 31. In the pressure reducing device 24, the refrigerant is throttled and expanded into a state of low-temperature and low-pressure two-phase gas-liquid refrigerant. The refrigerant flows into the heat source device 1*a*-1 through the fourth connection pipe 26.

Referring to FIG. 49, an action during the cooling operation of the air-conditioning apparatus 100 is described together with the flow of refrigerant.

In the compressor 1, the refrigerant turns into high-temperature and high-pressure refrigerant superheated vapor and flows into the heat source device 1*a*-1 through the first connection pipe 29 and the fifth connection pipe 27. The refrigerant flowing into the heat source device 1*a*-1 flows into the second heat exchanger 4-2 via the refrigerant collection pipe 20 and is cooled by exchanging heat with outdoor air supplied by the centrifugal fan 3 in the second heat exchanger 4-2. The refrigerant cooled by the second heat exchanger 4-2 flows out of the second heat exchanger 4-2 via the refrigerant distribution pipe 19 in a state of subcooled liquid or two-phase gas-liquid refrigerant. The refrigerant flowing out of the second heat exchanger 4-2 flows into the pressure reducing device 24 through the fourth connection pipe 26.

In the pressure reducing device 24, the refrigerant is throttled and expanded into a state of low-temperature and low-pressure two-phase gas-liquid refrigerant. The refrigerant flows into the load-side device 2*a* through the third connection pipe 31. The refrigerant flowing into the load-side device 2*a* receives heat from, for example, indoor air. In other words, the indoor air is cooled and the cooling operation is achieved. The refrigerant heated by the first heat exchanger 4-1 turns into two-phase gas-liquid refrigerant or superheated vapor having high quality and is sucked into the compressor 1 through the second connection pipe 30 and the sixth connection pipe 28. The refrigerant sucked into the compressor 1 is compressed again by the compressor 1 and is discharged as high-temperature and high-pressure refrigerant superheated vapor. Thereafter, this cycle is repeated.

Thus, the air-conditioning apparatus 100 includes at least one of the heat source device according to any one of Embodiment 1 to Embodiment 7 and the load-side device 2*a* according to Embodiment 9. Therefore, the degree of freedom in terms of disposition can be improved greatly.

A modification example of the air-conditioning apparatus 100 is described.

Figure 50:
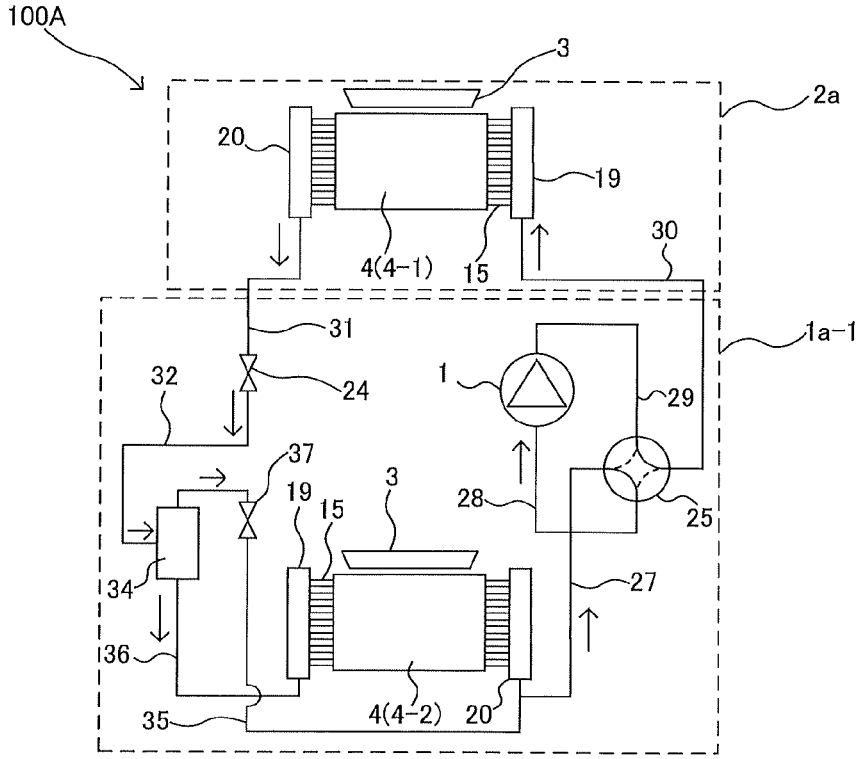
FIG. 50 is a structural view schematically illustrating an example of a refrigerant circuit structure in a modification example of the air-conditioning apparatus according to Embodiment 10 of the present disclosure.

FIG. 50 is a structural view schematically illustrating an example of a refrigerant circuit structure in the modification example of the air-conditioning apparatus 100. The modification example of the air-conditioning apparatus 100 is described with reference to FIG. 50. Note that the modification example of the air-conditioning apparatus 100 is distinguished as an air-conditioning apparatus 100A.

The air-conditioning apparatus 100A includes a gas-liquid separator 34 provided between the pressure reducing device 24 and the second heat exchanger 4-2, a bypass pipe 35 connecting the gas-liquid separator 34 and the outlet of the second heat exchanger 4-2, and at least one flow control device 37 disposed on the bypass pipe 35.

The gas-liquid separator 34 separates refrigerant into gas refrigerant and liquid refrigerant. The gas refrigerant separated by the gas-liquid separator 34 is sent to the flow control device 37. The liquid refrigerant separated by the gas-liquid separator 34 is sent to the second heat exchanger 4-2. The bypass pipe 35 is a refrigerant pipe that guides the gas refrigerant separated by the gas-liquid separator 34 to the outlet of the second heat exchanger 4-2. The flow control device 37 controls the flow rate of the refrigerant flowing through the bypass pipe 35.

The gas-liquid separator 34 is provided on an upstream side of refrigerant during the heating operation relative to the second heat exchanger 4-2 and the opening degree of the flow control device 37 is controlled during the heating operation. Therefore, the refrigerant can be supplied to the refrigerant distribution pipe 19 of the second heat exchanger 4-2 in an optimum refrigerant state depending on an operating condition. Thus, distribution performance is improved. Further, surplus gas refrigerant that does not contribute to heat exchange is bypassed. Therefore, a pressure loss can be reduced in the second heat exchanger 4-2 and the energy efficiency can be improved.

During the cooling operation, the gas-liquid separator 34 functions as a liquid reservoir to exert an effect to reduce a difference in the optimum refrigerant charging amount between the cooling operation and the heating operation. Further, the energy efficiency can be improved by optimizing the refrigerant charging amount.

Embodiments 1 to 8 are described above for the heat source device that is one type of the heat exchange unit according to the present disclosure but some of Embodiments 1 to 8 may be combined. Further, Embodiment 9 is only described for the load-side device that is one type of the heat exchange unit according to the present disclosure but a structure similar to that of a heat source device in any combination of Embodiments 1 to 8 may be applied to the load-side device. Further, Embodiment 10 is only described for the air-conditioning apparatus according to the present disclosure but a heat source device in any combination of Embodiments 1 to 8 and a load-side device in any combination of Embodiments 1 to 8 may be combined arbitrarily. For example, the air-conditioning apparatus 100 may include the heat source device 1*a*-2 according to Embodiment 2 and a load-side device having a structure similar to that of the heat source device 1*a*-6 according to Embodiment 6.

| Reference Signs List | |
|---|---|
| 1 compressor | 1a-1 to 1a-8 heat source device |
| 2 control box | 2a load-side device |

-continued

| Reference Signs List | |
|---|---|
| 3 centrifugal fan | 3a first centrifugal fan |
| 3b second centrifugal fan | 4 heat exchanger |
| 4-1 first heat exchanger | 4-2 second heat exchanger |
| 4a heat exchanger | 4b heat exchanger |
| 5 housing | 6 bypass air passage |
| 7 air inlet | 8 drain pan |
| 9 bypass partition plate | 10 air outlet |
| 11 fan-to-fan partition plate | 13 fan motor |
| 14A inflow air passage | 14B outflow air passage |
| 15 heat transfer tube | 16 circular tube |
| 17 flat tube | 18 fin |
| 19 refrigerant distribution pipe | 20 refrigerant collection pipe |
| 21 corrugated fin | 22, 22a, 22b heat exchanger |
| 23 heat exchanger | 24 pressure reducing device |
| 25 flow switching device | 26 fourth connection pipe |
| 27 fifth connection pipe | 28 sixth connection pipe |
| 29 first connection pipe | 30 second connection pipe |
| 31 third connection pipe | 34 gas-liquid separator |
| 35 bypass pipe | 37 flow control device |
| 40 bellmouth | 41 partition plate |
| 42 outflow air passage | 43 inlet/outlet partition plate |
| 45 fan inlet | 100 air-conditioning apparatus |
| 100A air-conditioning apparatus | |

The invention claimed is:

1. A heat exchange unit, comprising:

a housing having an inflow air passage communicating with an air inlet, and an outflow air passage communicating with an air outlet, with a height dimension of the housing being smallest among the height, width, and depth dimensions of the housing;

a first partition plate that partitions an inside of the housing into upper parts and lower parts to define the inflow air passage and the outflow air passage;

a bellmouth disposed around an opening formed in the first partition plate;

a centrifugal fan disposed on the first partition plate via the bellmouth and causes air to be blown in the circumferential direction in the air passage; and a heat exchanger disposed on a downstream side of the centrifugal fan in the housing, wherein the housing has two main plates in upper and lower parts of the rotational axis direction of the centrifugal fan and has sides including a front surface, a rear surface, a first side surface and a second side surface in the rotational axis direction of the centrifugal fan;

wherein the air outlet is open at the front surface;

wherein the air inlet is open at the rear surface, wherein the inflow air passage is formed between a fan inlet and a main plate closest to the fan inlet to reach a rear surface, the fan inlet being an air inlet of the centrifugal fan;

wherein the heat exchanger has upper and lower heat exchange portions at the front surface;

wherein the lower heat exchange portion is inclined so that a part closer to the air outlet is located higher than a part closer to the centrifugal fan, and the upper heat exchange portion is inclined so that a part closer to the centrifugal fan is located higher than a part closer to the air outlet;

wherein the inflow air passage does not reach the front of the housing due to a third partition plate that partitions the inflow air passage and the outflow air passage, and wherein the heat exchanger is disposed closer to the air outlet than the third partition plate.

2. The heat exchange unit of claim 1, wherein the housing has a rectangular shape in top view, and the front surface at which the air outlet is formed and the rear surface at which the air inlet is formed are surfaces along a long-side direction of the rectangular shape in top view, in the centrifugal fan, a first centrifugal fan and a second centrifugal fan are arranged side by side in a width direction, and the heat exchanger is disposed so as to be continuous from the front surface side of the first centrifugal fan and the front surface side of the second centrifugal fan.

3. The heat exchange unit of claim 1, wherein in the centrifugal fan, a first centrifugal fan and a second centrifugal fan are arranged side by side in a width direction, and the first centrifugal fan and the second centrifugal fan are disposed so that a central point of the first centrifugal fan and a central point of the second centrifugal fan are located on different straight lines running along the width direction of the housing.

4. The heat-exchange unit of claim 1, wherein the housing has a compressor that compresses refrigerant flowing the heat exchanger, and the compressor is arranged closer to a corner of the rear surface side of the housing than the centrifugal fan.

5. The heat exchange unit of claim 1, wherein the upper heat exchange portion and lower heat exchange portion are each inclined away from a plane perpendicular to an axial direction of the centrifugal fan.

6. The heat exchange unit of claim 1, wherein the third partition plate is attached to an end of the first partition plate.

7. The heat exchange unit of claim 1, wherein a fan motor configured to rotate the centrifugal fan is arranged in the outflow air passage.

8. The heat exchange unit of claim 1, wherein the upper heat exchange portion is inclined from a horizontal plane by a first inclination angle, and the lower heat exchange portion is inclined from the horizontal plane by a second inclination angle different from the first inclination angle.

9. The heat exchange unit of claim 1, wherein:

an axial direction of the centrifugal fan is vertical; and the upper heat exchange portion and the lower heat exchange portion are inclined from a horizontal plane.

10. A heat exchange unit comprising:

a housing having an inflow air passage communicating with an air inlet, and an outflow air passage communicating with an air outlet;

a first partition plate that partitions an inside of the housing into the inflow air passage and the outflow air passage;

a bellmouth disposed around an opening formed in the first partition plate;

a centrifugal fan disposed on the first partition plate via the bellmouth; and a heat exchanger disposed on a downstream side of the centrifugal fan in the housing, wherein the air inlet is open at a first surface of the housing having the inflow air passage, wherein the air outlet is open at a second surface of the housing having the outflow air passage, wherein the inflow air passage is formed between a fan inlet and a main plate closest to the fan inlet, wherein the heat exchanger is disposed around the centrifugal fan at a position where portions of the heat exchanger face the first surface of the housing and at least one other surface of the housing, and wherein the outflow air passage is provided with a second partition plate that defines a bypass air passage that guides, to the air outlet and out of the heat exchanger, air passing through a portion of the heat exchanger that faces the at least one other surface of the housing.

11. The heat exchange unit of claim 10, wherein a part of a fan motor configured to rotate the centrifugal fan protrudes into the bypass air passage.

12. The heat exchange unit of claim 10, wherein the bypass air passage and the housing are formed so that (H3/H1) falls within a range of 10% to 40%, where H1 is a height of the housing, and H3 is a height of the bypass air passage.

13. An air-conditioning apparatus, comprising a refrigerant circuit in which a compressor, and a pressure reducing device are connected by pipes, wherein the compressor is provided in a heat source device, and wherein at least one of the heat source device and a load-side device is the heat exchange unit of claim 10.

14. An air-conditioning apparatus, comprising a refrigerant circuit in which a compressor, a first heat exchanger, a pressure reducing device including an expansion valve, and a second heat exchanger are connected by pipes, wherein the first heat exchanger is provided in a load-side device including a heat exchanger unit, wherein the compressor and the second heat exchanger are provided in a heat source device, and wherein at least one of the heat source device and the load-side device is the heat exchange unit of claim 10.

* * * * *